US008811857B2

(12) United States Patent
Fukunaga et al.

(10) Patent No.: US 8,811,857 B2
(45) Date of Patent: Aug. 19, 2014

(54) SHEET FEEDING DEVICE, AND IMAGE FORMING APPARATUS PROVIDED WITH SAME

(71) Applicant: KYOCERA Document Solutions Inc., Osaka (JP)

(72) Inventors: Yasuyuki Fukunaga, Osaka (JP); Takeshi Ishii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/949,815

(22) Filed: Jul. 24, 2013

(65) Prior Publication Data

US 2014/0027974 A1 Jan. 30, 2014

(30) Foreign Application Priority Data

Jul. 26, 2012 (JP) ..... 2012-165628
Jul. 26, 2012 (JP) ..... 2012-165629

(51) Int. Cl.
*G03G 21/00* (2006.01)
*G03G 21/16* (2006.01)
*B65H 5/00* (2006.01)

(52) U.S. Cl.
CPC ..... *B65H 5/00* (2013.01); *G03G 21/1633* (2013.01); *G03G 21/1638* (2013.01)
USPC ..... 399/124; 271/264

(58) Field of Classification Search
USPC ..... 399/124; 271/264
See application file for complete search history.

(56) References Cited

U.S. PATENT DOCUMENTS

| | | | | |
|---|---|---|---|---|
| 8,315,539 | B2 * | 11/2012 | Uehara | 399/124 |
| 8,342,504 | B2 * | 1/2013 | Yamamoto | 271/9.09 |
| 8,442,418 | B2 * | 5/2013 | Koga et al. | 399/124 |
| 8,594,532 | B2 * | 11/2013 | Cook et al. | 399/124 |
| 2006/0083547 | A1 * | 4/2006 | Otaka | 399/124 |
| 2006/0120756 | A1 * | 6/2006 | Ahn et al. | 399/124 |
| 2010/0329737 | A1 | 12/2010 | Koga et al. | |

FOREIGN PATENT DOCUMENTS

| | | | | |
|---|---|---|---|---|
| JP | 8-2753 | | 1/1996 | |
| JP | 11249360 | A * | 9/1999 | G03G 15/00 |
| JP | 2005-70070 | | 3/2005 | |
| JP | 2009179441 | A * | 8/2009 | |

* cited by examiner

*Primary Examiner* — Kaitlin Joerger
(74) *Attorney, Agent, or Firm* — Gerald E. Hespos; Michael J. Porco; Matthew T. Hespos

(57) ABSTRACT

The sheet feeding device includes a housing, first and second feeding paths, and first and second covers. The first feeding path extends in a vertical direction within the housing. The second feeding path extends in the vertical direction within the housing, and a lower end thereof is connected to an upper end of the first feeding path. The first cover exposes, in an open state, the first feeding path outside of the housing. The second cover exposes, in an open state, the second feeding path outside of the housing. When both the first cover and the second cover are opened, the first cover and the second cover are respectively in the open state relative to the housing in a mode where a second opening angle of the second cover relative to the housing is smaller than a first opening angle of the first cover relative to the housing.

13 Claims, 22 Drawing Sheets

SHEET FEEDING DEVICE, AND IMAGE FORMING APPARATUS PROVIDED WITH SAME

This application relates to and claims priority from Japanese Patent Application Nos. 2012-165628 and 2012-165629, filed on Jul. 26, 2012 with the Japan Patent Office, the entire disclosure of which is incorporated herein by reference.

BACKGROUND

With an image forming apparatus which forms an image on a sheet, a toner image is formed on a photoconductive drum in an image forming unit, and the toner image is transferred to the sheet at a transfer nip part formed between the photoconductive drum and a transfer roller. The image forming apparatus additionally includes a fixing unit, and the sheet to which the toner image has been transferred is subject to fixing operation in the fixing unit and thereafter discharged outside the apparatus.

In the foregoing image forming apparatus, since different sized sheets are used, a sheet feeding device including a plurality of levels of sheet cassettes is disposed below the image forming unit. The sheets that are sent out from the respective sheet cassettes are fed to a sheet feeding path that is extended in the vertical direction to one end side of the plurality of levels of sheet cassettes, and thereafter fed to the image forming unit and a toner image is formed thereon.

In order to remove a sheet in the case of a sheet jam in the sheet feeding path that is extended across the plurality of levels of sheet cassettes, a cover for opening the sheet feeding path to the outside is disposed. For example, a plurality of opening/closing doors are disposed facing the sheet feeding path that is extended in the vertical direction. In the foregoing case, the lower opening/closing door is opened, and, when the operator views the sheet feeding path, there have been cases where the line of sight has been obstructed by the upper opening/closing door that has previously been opened.

An object of the present disclosure is to improve the visibility of the sheet feeding path from the outside in a sheet feeding device provided with a plurality of opening/closing covers for opening the sheet feeding path, that is extended in the vertical direction, to the outside.

SUMMARY

The sheet feeding device according to one aspect of the present disclosure includes a housing, first and second feeding paths for feeding a sheet, and first and second covers. The first feeding path extends in a vertical direction within the housing. The second feeding path extends in the vertical direction within the housing, and a lower end thereof is connected to an upper end of the first feeding path. The first cover, in which an upper side is openable/closable relative to the housing with a lower side as a fulcrum, exposes, in an open state, the first feeding path outside of the housing. The second cover, in which an upper side is openable/closable relative to the housing with a lower side as a fulcrum, exposes, in an open state, the second feeding path outside of the housing. When both the first cover and the second cover are in the open state, the first cover and the second cover are respectively in the open state relative to the housing in a mode where a second opening angle of the second cover relative to the housing is smaller than a first opening angle of the first cover relative to the housing.

Moreover, the image forming apparatus according to another aspect of the present disclosure includes the foregoing sheet feeding device, and an image forming unit for forming an image on the sheet fed from the first feeding path or the second feeding path.

DETAILED DESCRIPTION

Embodiments of the present disclosure are now explained in detail with reference to the drawings.

First Embodiment

Figure 1:
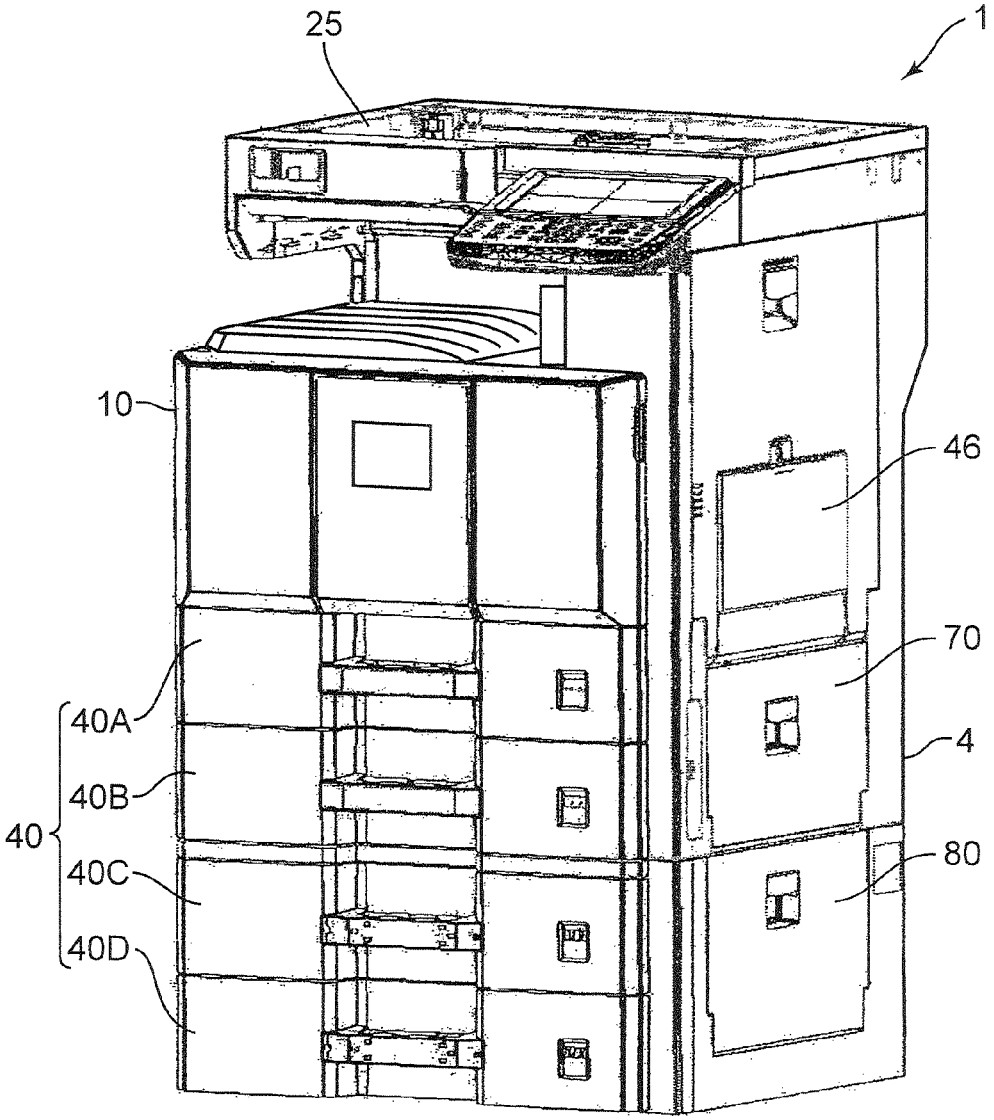
FIG. 1 is a perspective view of the image forming apparatus according to the first embodiment of the present disclosure.
Figure 2:
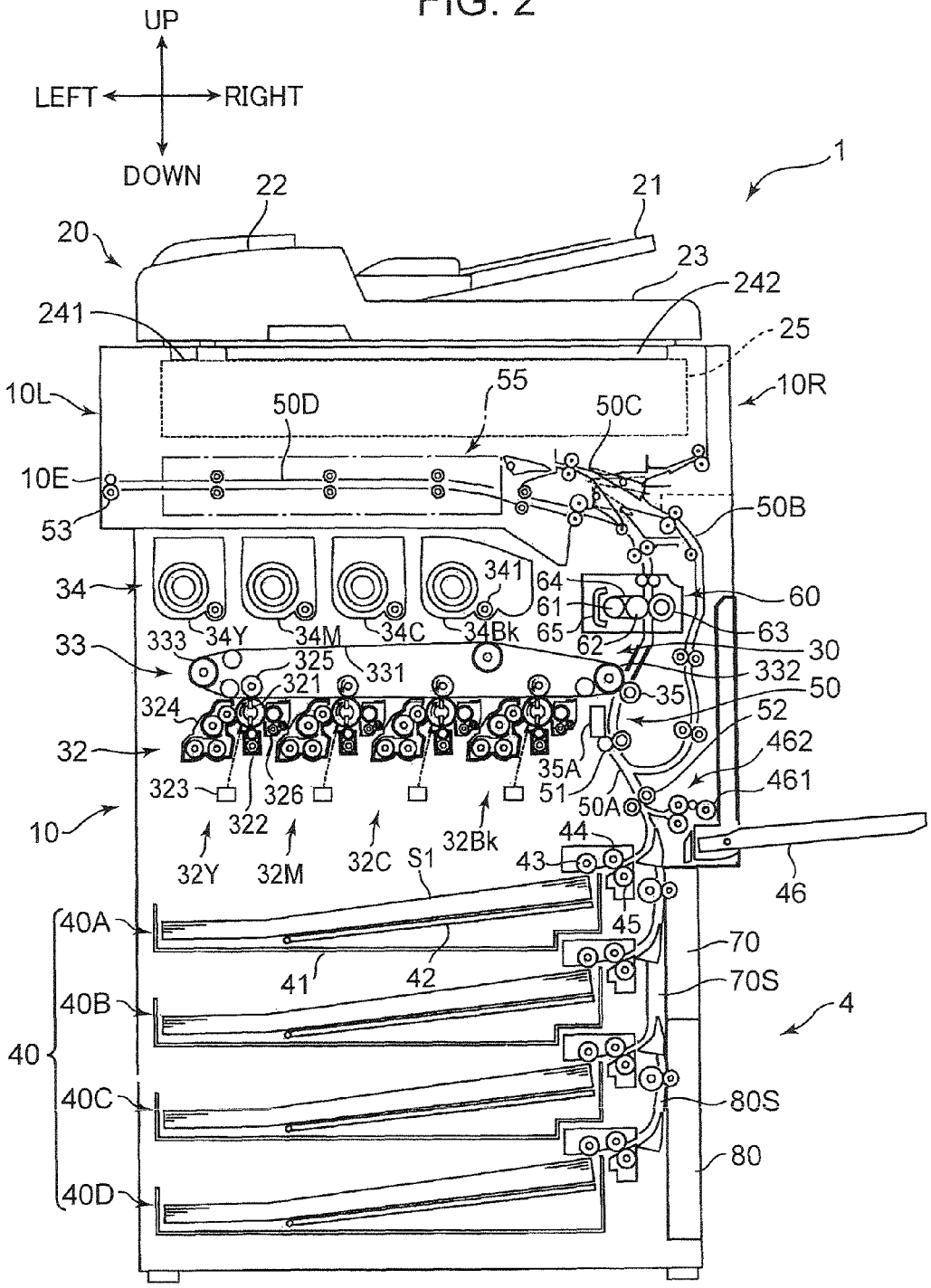
FIG. 2 is a cross section showing the internal structure of the image forming apparatus according to the first embodiment.

FIG. 1 is a perspective view of the image forming apparatus 1 according to the first embodiment of the present disclosure, and FIG. 2 is a cross section showing the internal structure of the image forming apparatus 1. Note that, in FIG. 1, the automatic document feeder 20 and the feeding unit 55 shown in FIG. 2 are not illustrated. Here, while a multi-function machine including a printer function and a copier function is illustrated as the image forming apparatus 1, the image forming apparatus may also be a printer, a copier or a facsimile machine.

The image forming apparatus 1 includes a device body 10 (housing) having a substantially rectangular parallelepipedic housing structure, and an automatic document feeder 20 disposed on the device body 10. The device body 10 internally houses a reading unit 25 for optically reading a document image to be copied, an image forming unit 30 for forming a toner image on a sheet, a fixing unit 60 for fixing the toner image to the sheet, a sheet feeding part 40 for storing a standard sheet to be fed to the image forming unit 30, a feeding path 50 for feeding a standard sheet from the sheet feeding part 40 or the sheet feeding tray 46 to the sheet discharge outlet 10E via the image forming unit 30 and the fixing unit 60, and a feeding unit 55 internally having a sheet feeding path which configures a part of the feeding path 50.

The automatic document feeder (ADF) 20 is turnably mounted on the top face of the device body 10. The ADF 20 automatically feeds a document sheet to be copied toward a predetermined document reading position (position where the first contact glass 241 is installed) in the device body 10. Meanwhile, when the user is to manually place a document sheet at a predetermined document reading position (position where the second contact glass 242 is disposed), the ADF 20 is opened upward. The ADF 20 includes a document tray 21 on which document sheets are loaded, a document feeding part 22 for feeding a document sheet via an automatic document reading position, and a document discharge tray 23 to which the read document sheet is discharged.

The reading unit 25 optically reads the image of the document sheet through the first contact glass 241 for reading the document sheet that is automatically fed from the ADF 20 on the top face of the device body 10, or the second contact glass 242 for reading the manually placed document sheet. The reading unit 25 internally houses a scanning mechanism including a light source, a moving carriage, and a reflecting mirror and the like, and an imaging element (not shown). The scanning mechanism causes the document sheet to be irradiated with light, and guides the reflected light thereof to the imaging element. The imaging element photoelectrically converts the reflected light into an analog electric signal. The analog electric signal is converted into a digital electric signal with an A/D conversion circuit, and thereafter input to the image forming unit 30.

The image forming unit 30 forms a full-color toner image and performs processing for transferring such toner image onto the sheet, and includes an image forming units 32 including four units 32Y, 32M, 32C, 32Bk forming the respective toner images of yellow (Y), magenta (M), cyan (C) and black (Bk) disposed in tandem, an intermediate transfer unit 33 disposed adjacent on the image forming units 32, and a toner supply part 34 disposed on the intermediate transfer unit 33.

The respective image forming units 32Y, 32M, 32C, 32Bk include a photoconductive drum 321, and a charger 322, a developer 323, a developing device 324, a primary transfer roller 325 and a cleaning device 326 which are disposed around the photoconductive drum 321.

The photoconductive drum 321 rotates around its axis, and an electrostatic latent image and a toner image are formed on its peripheral surface. As the photoconductive drum 321, a photoconductive drum using an amorphous silicon (a-Si)-based material may be used. The charger 322 uniformly charges the peripheral surface of the photoconductive drum 321. The developer 323 includes a laser light source and optical equipment such as a mirror and a lens, and forms an electrostatic latent image by causing the peripheral surface of the photoconductive drum 321 to be irradiated with light based on the image data of the document image.

The developing device 324 supplies a toner to the peripheral surface of the photoconductive drum 321 for developing the electrostatic latent image formed on the photoconductive drum 321. The developing device 324 is for a two-component developer, and includes a screw feeder, a magnetic roller, and a development roller.

The primary transfer roller 325 forms a nip part with the photoconductive drum 321 across the intermediate transfer belt 331 provided to the intermediate transfer unit 33, and primarily transfers the toner image on the photoconductive drum 321 onto the intermediate transfer belt 331. The cleaning device 326 includes a cleaning roller and the like, and cleans the peripheral surface of the photoconductive drum 321 after the transfer of the toner image.

The intermediate transfer unit 33 includes an intermediate transfer belt 331, a drive roller 332 and a driven roller 333. The intermediate transfer belt 331 is an endless belt that is placed across the drive roller 332 and the driven roller 333, and toner images from a plurality of photoconductive drums 321 are transferred in a superimposed manner at the same location on the outer peripheral face of the intermediate transfer belt 331 (primary transfer).

A secondary transfer roller 35 is disposed facing the peripheral surface of the drive roller 332. The nip part of the drive roller 332 and the secondary transfer roller 35 serve as a secondary transfer part for transferring, onto the sheet, the full-color toner image that was superimposed on the intermediate transfer belt 331. A secondary transfer bias potential of a reverse polarity against the toner image is applied to the secondary transfer roller 35, and the drive roller 332 is grounded.

The toner supply part 34 includes a yellow toner container 34Y, a magenta toner container 34M, a cyan toner container 34C, and a black toner container 34Bk. These toner containers 34Y, 34C, 34M, 34Bk respectively store toners of the respective colors, and supply toners of the respective colors, through a supply path not shown, to the developing device 324 of the image forming units 32Y, 32M, 32C, 32Bk corresponding to the respective colors of YMCBk. The respective toner containers 34Y, 34C, 34M, 34Bk are provided with a feeding screw 341 for feeding the toners within the containers to a toner discharge outlet not shown. The toners are supplied into the developing device 324 as a result of the feeding screw 341 being rotatably driven by a drive unit not shown.

The sheet feeding part 40 includes a first sheet feeding cassette 40A, a second sheet feeding cassette 40B (second sheet loading part), a third sheet feeding cassette 40C (second sheet loading part), and a fourth sheet feeding cassette 40D (first sheet loading part) of four levels for housing standard sheets S1 among the sheets to be subject to image forming processing. These sheet feeding cassettes are detachably mounted on the device body 10; specifically, in a manner so that the sheet feeding cassettes can be pulled toward the front side from the front of the device body 10.

The first sheet feeding cassette 40A includes a sheet housing part 41 for housing a sheet bundle in which the standard sheets S1 are stacked, and a lift plate 42 which lifts up the sheet bundle for feeding the sheets. A pickup roller 43, and a roller pair of a sheet feeding roller 44 and a retard roller 45 are disposed at the top part on the right end side of the sheet feeding cassette 40A. As a result of the pickup roller 43 and the sheet feeding roller 44 being driven, the uppermost sheet S1 of the sheet bundle in the sheet feeding cassette 40A is fed one by one, and delivered to the upstream end of the feeding path 50. Note that the second sheet feeding cassette 40B, the third sheet feeding cassette 40C and the fourth sheet feeding cassette 40D are also configured in the same manner as the first sheet feeding cassette 40A. Moreover, the third sheet feeding cassette 40C and the fourth sheet feeding cassette 40D are so-called add-on type sheet feeding cassettes configured integrally, and are cassettes that are mounted ex post facto on the image forming apparatus 1 in a state where the first sheet feeding cassette 40A and the second sheet feeding cassette 40B are mounted.

A right side face 10R of the device body 10 is provided with a sheet feeding tray 46 for manually feeding sheet. The sheet feeding tray 46 is openably/closably mounted on the device body 10 at the lower end thereof. When the user is to manually feed sheet, the user opens the sheet feeding tray 46 as illustrated in the diagram, and places the sheet thereon. The sheet that was placed on the sheet feeding tray 46 is fed to the feeding path 50 as a result of the pickup roller 461 and the sheet feeding roller 462 being driven.

The feeding path 50 includes a main feeding path 50A for feeding the sheet (standard sheet S1) from the sheet feeding part 40 to the fixing unit 60 via the image forming unit 30, a reverse feeding path 50B for returning the sheet, in which one side thereof has been printed, to the image forming unit 30 in the case of printing both faces of the sheet, a switch back feeding path 50C for feeding the sheet from the downstream end of the main feeding path 50A to the upstream end of the reverse feeding path 50B, and a horizontal feeding path 50D for feeding the sheet in the horizontal direction from the downstream end of the main feeding path 50A to the sheet discharge outlet 10E provided to a left side wall 10L of the device body 10. Most of the horizontal feeding path 50D is configured from the sheet feeding path that is provided inside the feeding unit 55.

A resist roller pair 51 is disposed on the main feeding path 50A on a side that is more upstream than the secondary transfer part 35A. The sheet is once stopped at the resist roller pair 51 in a stopped state, and subject to skew correction. Subsequently, at a predetermining timing for image transfer, the sheet is transferred to the secondary transfer part by the resist roller pair 51 being rotatably driven by a drive motor (not shown). In addition, a plurality of feeding rollers 52 for feeding the sheet are disposed on the main feeding path 50A.

The feeding path 50 additionally includes an upward feeding path 70S (second feeding path) and a downward feeding path 80S (first feeding path) which extend in a vertical direction within the device body 10 and on which the sheet is fed. The downward feeding path 80S is a feeding path that is extended in a vertical direction on the rights side of the device body 10. The upward feeding path 70S is extended in a vertical direction in the device body 10 and its lower end is connected to an upper end of the downward feeding path 80S. The sheets delivered from the second sheet feeding cassette 40B and the third sheet feeding cassette 40C are fed from a lower side to an upper side on the upward feeding path 70S, and thereafter reach the feeding roller 52. The sheets delivered from the fourth sheet feeding cassette 40D pass through the downward feeding path 80S, are additionally fed through the upward feeding path 70S, and thereafter reach the feeding roller 52.

A sheet discharge roller 53 is disposed at the downstream-most end of the feeding path 50. The sheet discharge roller 53 discharges the sheet, through the sheet discharge outlet 10E, to the post-processing device not shown disposed on the left side wall 10L of the device body 10. Note that, with an image forming apparatus that is not provided with a post-processing device, the sheet discharge tray is provided below the sheet discharge outlet 10E.

The feeding unit 55 is a unit for feeding the sheet, which was sent from the fixing unit 60, to the sheet discharge outlet 10E. With the image forming apparatus 1 of this embodiment, the fixing unit 60 is disposed on the side of the right side face 10R of the device body 10, and the sheet discharge outlet 10E is disposed on the side of the left side wall 10L of the device body 10 facing the right side face 10R. Accordingly, the feeding unit 55 feeds the sheet in the horizontal direction from the right side face 10R toward the left side wall 10L of the device body 10.

The fixing unit 60 is an induction heating-type fixing device for performing fixing process of fixing the toner image on the sheet, and includes a heating roller 61, a fixing roller 62, a pressing roller 63, a fixing belt 64 and an induction heating unit 65. The pressing roller 63 is pressed against the fixing roller 62 to form a fixing nip part. The heating roller 61 and the fixing belt 64 are induction heated by the induction heating unit 65, and provides the heat thereof to the fixing nip part. As a result of the sheet passing through the fixing nip part, the toner image that was transferred to the sheet is fixed to the sheet.

The image forming apparatus 1 additionally includes an upper door 70 (second cover) and a lower door 80 (first cover). The upper door 70 and the lower door 80 are disposed at a position below the right side face 10R of the device body 10. The upper door 70 and the lower door 80 are openable/closable relative to the device body 10. In other words, the upper portion of the upper door 70 is opened and closed against the device body 10 with the lower portion thereof as the fulcrum. Similarly, the upper portion of the lower door 80 is also opened and closed against the device body 10 with the lower portion thereof as the fulcrum. When the upper door 70 is in an open state to the device body 10 (right side face 10R), the upward feeding path 70S is exposed outside the device body 10. Moreover, when the lower door 80 is in an open state to the device body 10 (right side face 10R), the downward feeding path 80S is exposed outside the device body 10. As a result of the upper door 70 and the lower door 80 being opened and closed as described above, even when a sheet jam occurs in the upward feeding path 70S or the downward feeding path 80S, the operator can easily remove the sheet.

In the foregoing configuration, the sheet feeding device (sheet feeding device) of the image forming apparatus 1 is configured by the sheet feeding part 40 (first sheet feeding cassette 40A, the second sheet feeding cassette 40B, the third sheet feeding cassette 40C, fourth sheet feeding cassette 40D) and the upward feeding path 70S, the upper door 70, the downward feeding path 80S, and the lower door 80. As described above, the sheet feeding device 4 supplies the standard sheet S1 to the image forming unit 30.

Figure 3:
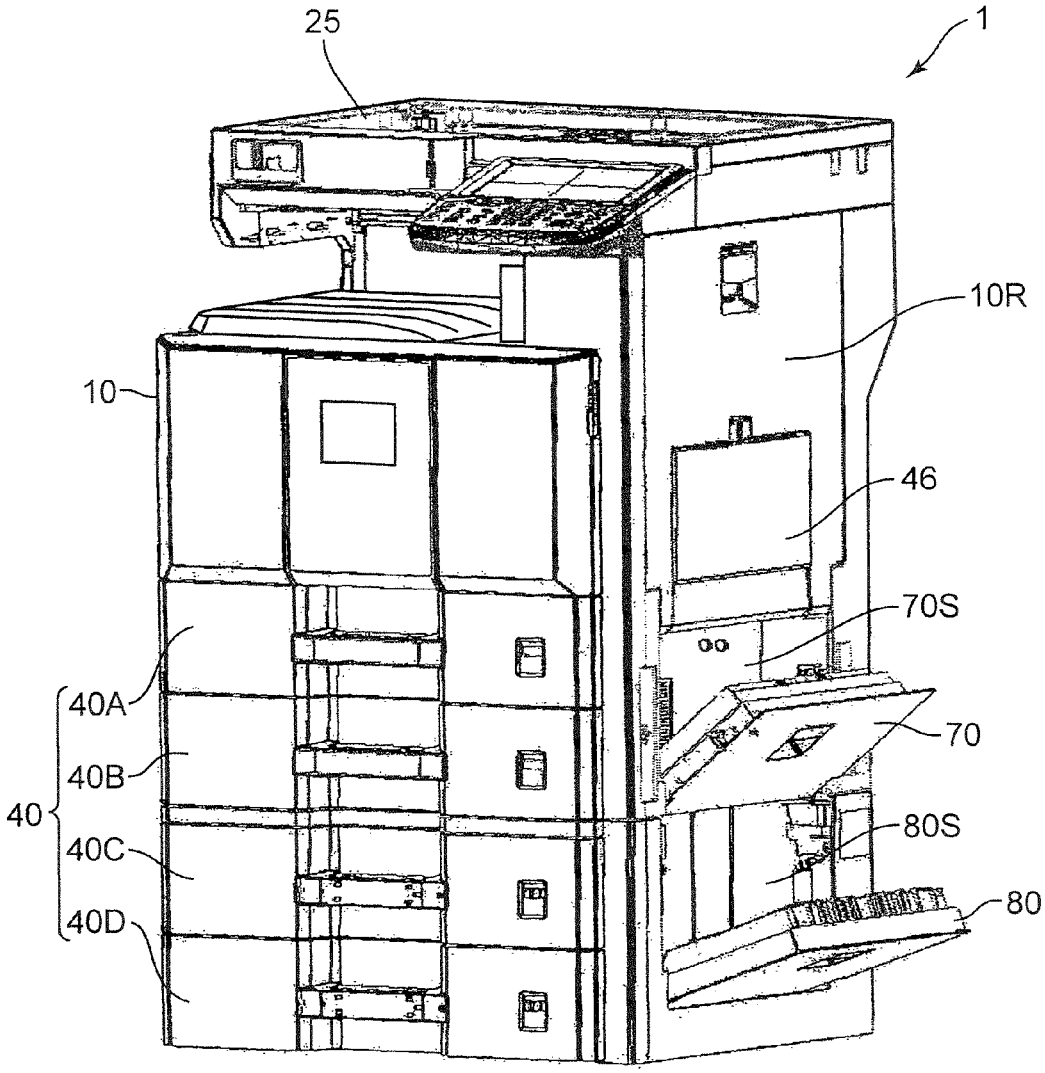
FIG. 3 is a perspective view of the image forming apparatus in which the upper door and the lower door are in an open state from the state shown in FIG. 1.
Figure 4:
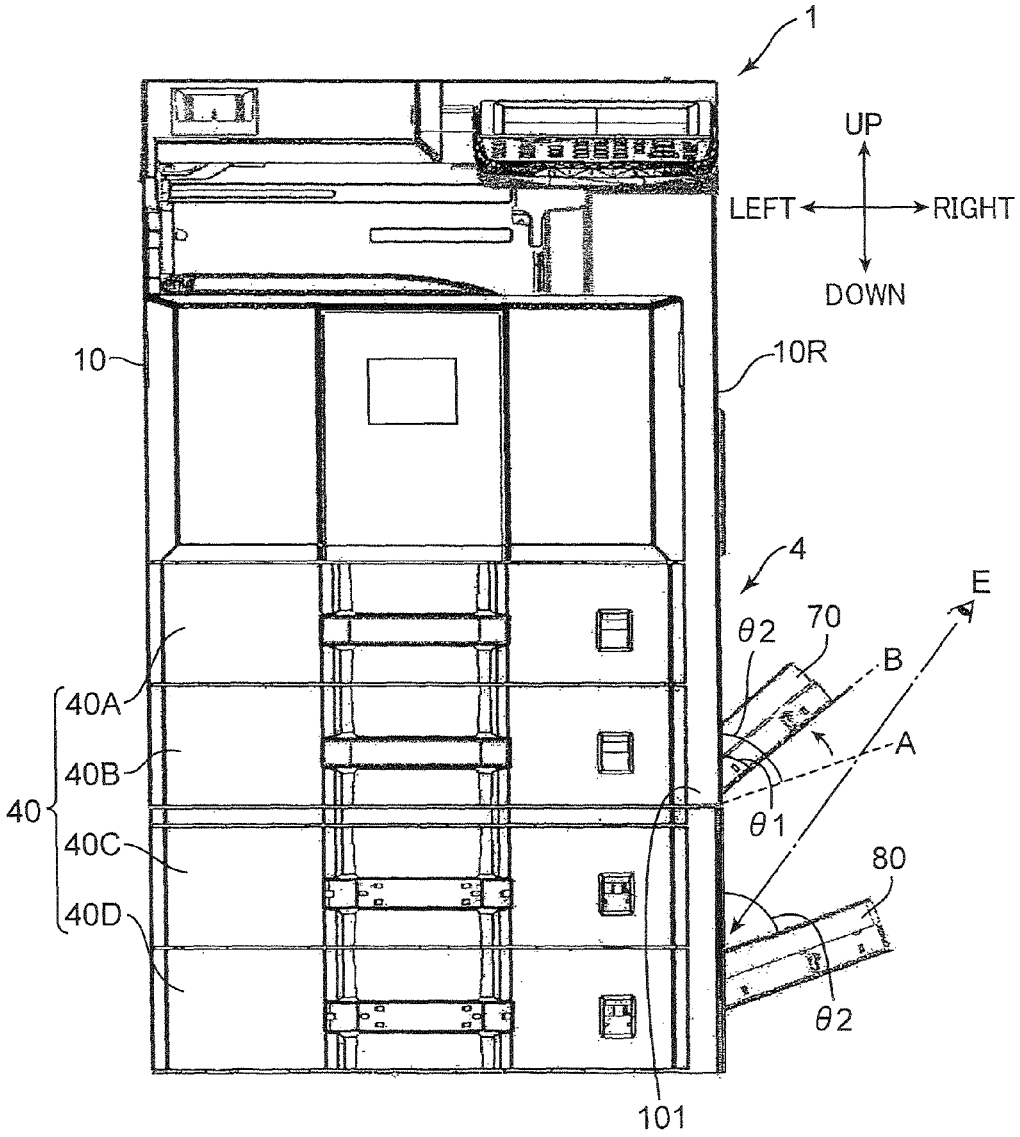
FIG. 4 is a front view of the image forming apparatus in the state shown in FIG. 3.
Figure 5A:
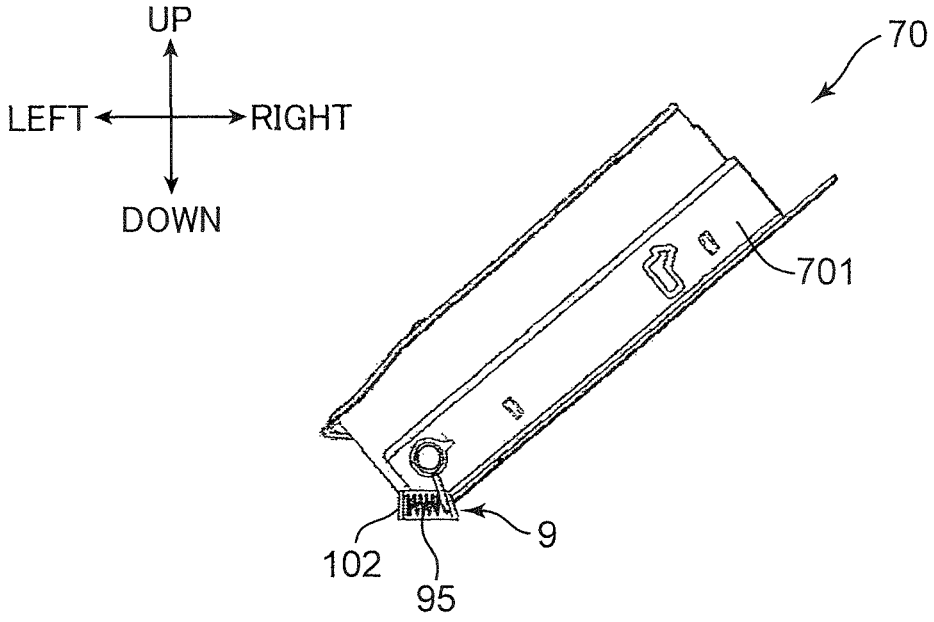
FIG. 5A and FIG. 5B are enlarged views of the upper door and the lower door in FIG. 4.
Figure 5B:
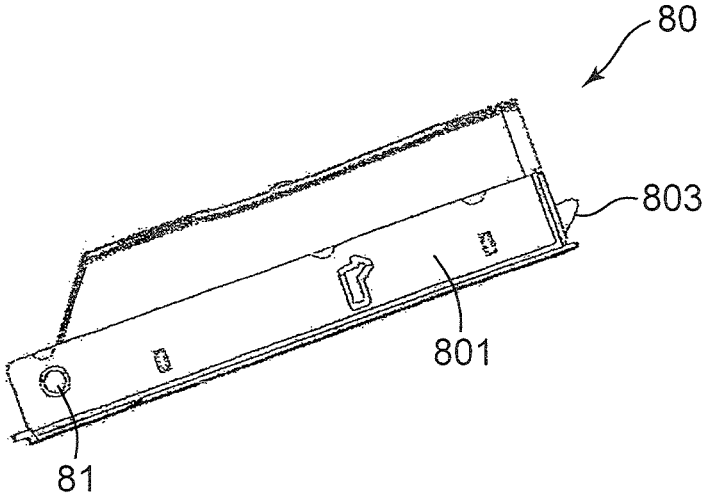

The opening/closing modes of the upper door 70 and the lower door 80 are now explained. FIG. 3 is a perspective view when the upper door 70 and the lower door 80 are in an open state to the device body 10, and FIG. 4 is a front view thereof. In addition, FIGS. 5A and 5B are diagrams showing only the upper door 70 and the lower door 80 respectively in the state shown in FIG. 4.

As described above, when the upper door 70 is in an open state, the upward feeding path 70S is opened outside the device body 10. Meanwhile, when the lower door 80 is in an open state, the downward feeding path 80S is opened outside the device body 10. Here, when a sheet jam occurs in the image forming apparatus 1, the operator often opens the doors in order from the door that is closest to the operator's hand, in a standing state, in order to search for the location of the sheet jam. In other words, it is often the case that the upper door 70 is foremost opened, and the lower door 80 is subsequently opened.

In FIG. 4, on the assumption that the upper door 70 and the lower door 80 are opened at the same opening angle relative to the right side face 10R, the upper door 70 will be disposed at position A in FIG. 4 at an opening angle θ2. In the foregoing case, the upper door 70 blocks a part of the operator's line of sight E for viewing the inside (downward feeding path 80S) of the lower door 80. In addition, if the sheet is jammed on the feeding path 50 in a state of going across the upward feeding path 70S and the downward feeding path 80S, the jam correction process can be easily performed in a state when both the upper door 70 and the lower door 80 are opened. In the foregoing case also, the upper door 70 will hinder the visibility of the lower portion (downward feeding path 80S) of the sheet feeding path.

In this embodiment, in order to resolve the foregoing problem, the relation of the opening angles of the upper door 70 and the lower door 80 are set appropriately. In other words, when the upper door 70 and the lower door 80 are in an open state, the upper door 70 and the lower door 80 respectively become an open state relative to the device body 10 in a mode where the opening angle of the upper door 70 relative to the device body 10 (right side face 10R) is smaller than the opening angle of the lower door 80 relative to the device body 10 (right side face 10R).

In this embodiment, as shown in FIG. 4, the opening angle of the lower door 80 relative to the device body 10 is an angle θ2 (first opening angle). When the lower door 80 is in an open state, the opening angle of the upper door 70 relative to the device body 10 is an angle θ1 (second opening angle). The angle θ1 is set to be smaller than the angle θ2 (third opening angle), which is the opening angle of the upper door 70 relative to the device body 10 when the lower door 80 is in a closed state. In other words, when the lower door 80 is in a closed state, the upper door 70 is opened widely to the device body 10 at the same opening angle θ2 as the lower door 80. Accordingly, the upward feeding path 70S can be easily exposed outside the device body 10, and the operator can easily view the upward feeding path 70S. Meanwhile, when both the upper door 70 and the lower door 80 are in an open state, the upper door 70 is opened to the device body 10 at the angle θ1 that is smaller than the angle θ2. Thus, the upper door 70 will not block the operator's line of sight E. Thus, the operator can favorably view the upward feeding path 70S and the downward feeding path 80S.

Figure 6:
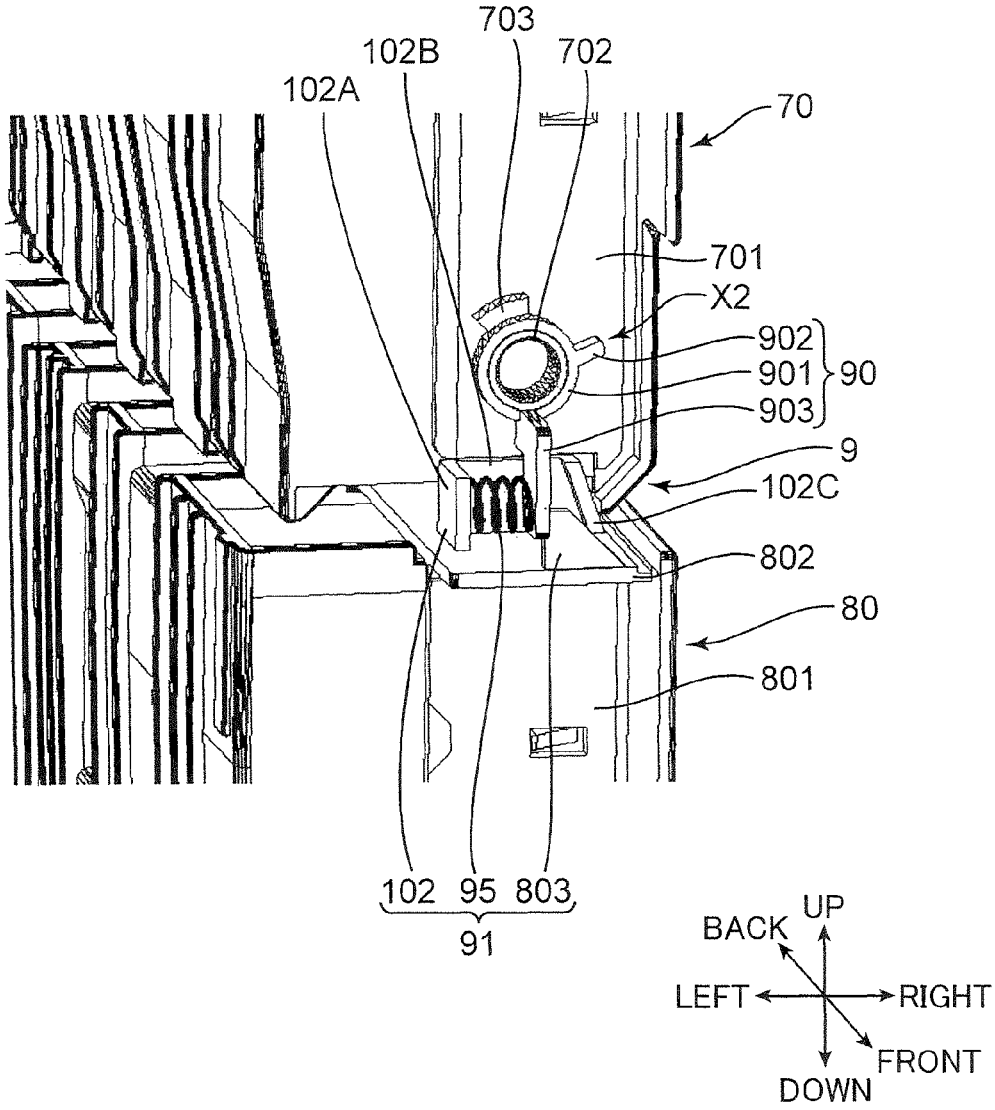
FIG. 6 is a perspective view showing the periphery of the restricting part when the upper door and the lower door are in a closed state.

The image forming apparatus 1 additionally includes a restricting part 9 (FIG. 5A). The restricting part 9 has a function of restricting the opening angle of the upper door 70 to the angle θ1 (second opening angle) or the angle θ2 (third opening angle) in conjunction with the status changing operation between an open state and a closed state of the lower door 80. The restricting part 9 is now explained in detail with reference to FIG. 6 and FIG. 7. FIG. 6 is a perspective view showing the periphery of the restricting part 9 when the upper door 70 and the lower door 80 are in a closed state, and FIG. 7 is a top view showing the periphery of the restricting part 9 when the upper door 70 and the lower door 80 are in a closed state.

The upper door 70 includes an upper front wall part 701 and an upper turning axis 702. The upper front wall part 701 is the side wall on the front side of the upper door 70. The upper turning axis 702 is the fulcrum of the upper door 70 in its open/close motion, and serves as the rotating axis in the turning of the upper door 70. The upper turning axis 702 extends in a direction which intersects with the feeding direction of the sheet in the upward feeding path 70S, and has a cylindrical shape which protrudes from the upper front wall part 701 toward the front side.

Figure 7:
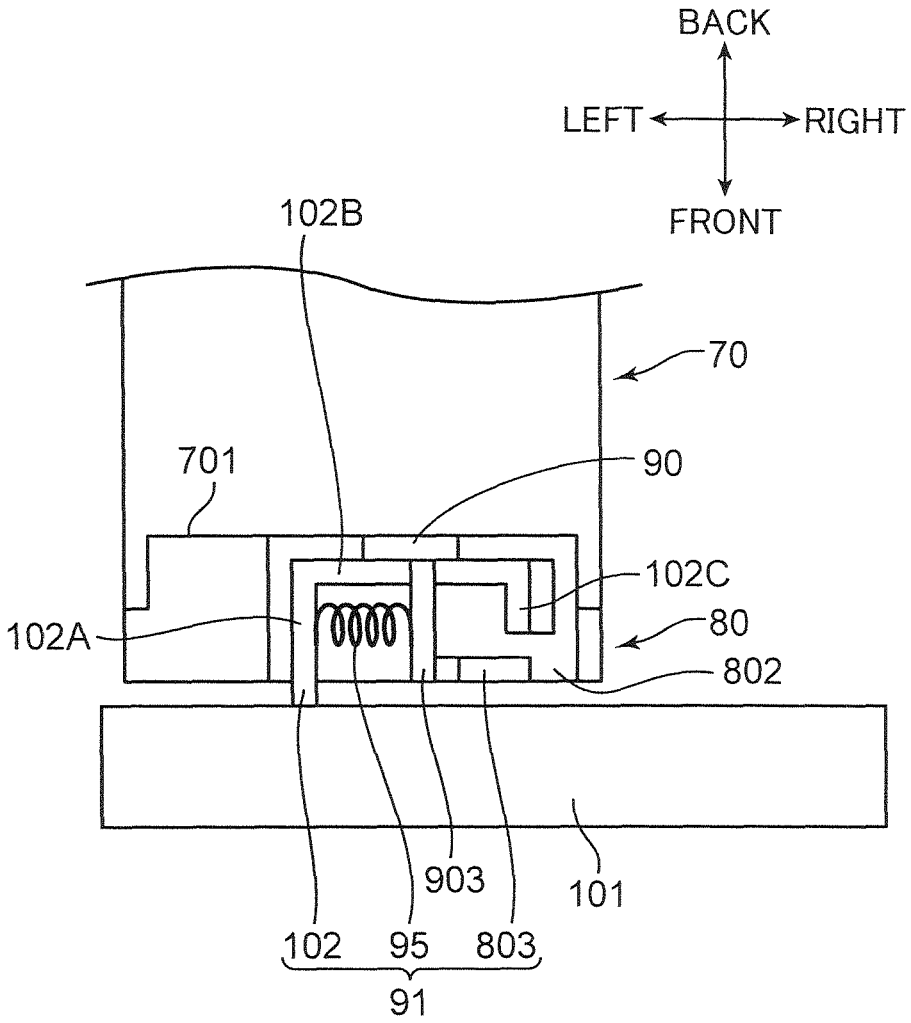
FIG. 7 is a top view showing the periphery of the restricting part when the upper door and the lower door are in a closed state.

The device body 10 of the image forming apparatus 1 includes a front frame 101 disposed in front of the upper door 70 (refer to FIG. 4 and FIG. 7). As a result of a shaft part not shown that is installed in a protruding manner from the front frame 101 toward the rear being inserted into the upper turning axis 702, the fulcrum (rotating axis) of the upper door 70 in its open/close motion is formed. Note that a similar turning axis as the upper turning axis 702 is also disposed on the side wall on the rear side of the upper door 70. As with the upper door 70, the lower door 80 includes a lower front wall part 801. A lower turning axis 81 is disposed on the lower front wall part 801. The lower front wall part 801 is a side wall on the front side of the lower door 80.

The restricting part 9 includes a protruding part 703 (protrusion), a restricting member 90 and a move part 91. The protruding part 703 is an arc shaped member centered around the rotating shaft center of the upper turning axis 702, and is installed in a protruding manner at a position at a given interval from the rotating shaft center in a radial direction in the rotation around the upper turning axis 702. Specifically, the protruding part 703 is an arc shaped member which is installed in a protruding manner from the upper front wall part 701 to the front side at an interval from the outer peripheral portion of the upper turning axis 702 in the radial direction, and disposed along the outer peripheral portion of the upper turning axis 702. The protruding part 703 has a width worth approximately 30 degrees in the peripheral direction of the upper turning axis 702 at the upper and leftward position relative to the shaft center of the upper turning axis 702.

The restricting member 90 is fitted into the outer peripheral portion of the upper turning axis 702, and rotatably supported relative to the upper turning axis 702. The restricting member 90 can change positions, based on the rotation, between a first position X1 (FIG. 9) which comes into contact with the protruding part 703 and restricts the opening angle of the upper door 70 relative to the angle θ1 (second opening angle), and a second position X2 (FIG. 8) which restricts the opening angle of the upper door 70 relative to the angle θ2 (third opening angle) while coming into contact with the protruding part 703. The restricting member 90 includes a ring part 901, a stopper 902 (first protruding part), and an engaging piece 903 (second protruding part).

The ring part 901 is the body portion of the restricting member 90, and is configured in a ring shape having an inner diameter that is slightly larger than the outer diameter of the upper turning axis 702. The ring part 901 is fitted on the outer peripheral portion of the upper turning axis 702, and is fitted between the upper turning axis 702 and the protruding part 703, whereby the ring part 901 is turnable around the upper turning axis 702.

The stopper 902 is installed in a protruding manner from the ring part 901 to the outer radial side of the upper turning axis 702. The stopper 902 can come into contact with the protruding part 703 in accordance with the turning of the ring part 901. As shown in FIG. 6, when the upper door 70 and the lower door 80 are in a closed state, the stopper 902 protrudes from the upper turning axis 702 in a direction heading rightward and slightly upward.

The engaging piece 903 is installed in a protruding manner from the ring part 901 to the outer radial side at an interval in the peripheral direction of the upper turning axis 702 relative to the stopper 902. The engaging piece 903 is a member that is wide in the front-back direction so as to protrude more frontward than the ring part 901. When the upper door 70 and the lower door 80 are in a closed state, the engaging piece 903 protrudes from the upper turning axis 702 in a downward direction.

The move part 91 is disposed below the restricting member 90. The move part 91 moves the restricting member 90 to the first position X1 or the second position X2 in correspondence with the lower door 80 in an open state or a closed state. The move part 91 includes a bracket 102, a bias spring 95 (biasing member), and a contact piece 803.

The bracket 102 is fixed to the front frame 101 of the device body 10. The bracket 102 has a U-shape that is opened frontward in a top view (FIG. 7). The bracket 102 includes a left wall part 102A (first wall part), a rear wall part 102B and a right wall part 102C (second wall part). The left wall part 102A is a wall part on the left side of the bracket 102. Note that, as shown in FIG. 7, the front side end of the left wall part 102A is fixed to the front frame 101. The right wall part 102C is a wall part on the right side of the bracket 102. The rear wall part 102B connects the rear side ends of the left wall part 102A and the right wall part 102C. With regard to the left wall part 102A and the right wall part 102C, to put it differently, the left wall part 102A and the right wall part 102C face each other so as to sandwich the engaging piece 903 of the restricting member 90 in a direction (left-right direction) which intersects with the rotating axis of the upper turning axis 702. Note that the right wall part 102C is disposed to face the left-right direction relative to the rear side portion of the engaging piece 903. In other words, the engaging piece 903 is protruding more frontward than the right wall part 102C.

The bias spring 95 is disposed in a compressible manner between the left wall part 102A and the engaging piece 903.

The contact piece 803 is disposed on the lower door 80. Thus, the contact piece 803 moves integrally with the lower door 80 in response to the open/close motion of the lower door 80. More specifically, the contact piece 803 is a protruding piece that is installed in a protruding manner in an upward direction from the upper plate 802 configuring the top face of the lower door 80 with a slight thickness in the front-back direction. The contact piece 803 is a substantially triangular shape in which the right side end is tilted.

The contact piece 803 comes into contact with the engaging piece 903 on the side that is opposite to the bias spring 95 with the lower door 80 in a closed state. Here, the contact piece 803 is disposed on the front side of the right wall part 102C, and comes into contact with the front side portion of the engaging piece 903. Consequently, the restricting member 90 is disposed at the second position X2. Moreover, the contact piece 803 is separated from the engaging piece 903 with the lower door 80 in an open state, and permits the engaging piece 903 to come into contact with the right wall part 102C. Consequently, the restricting member 90 is disposed at the first position X1.

Figure 8:
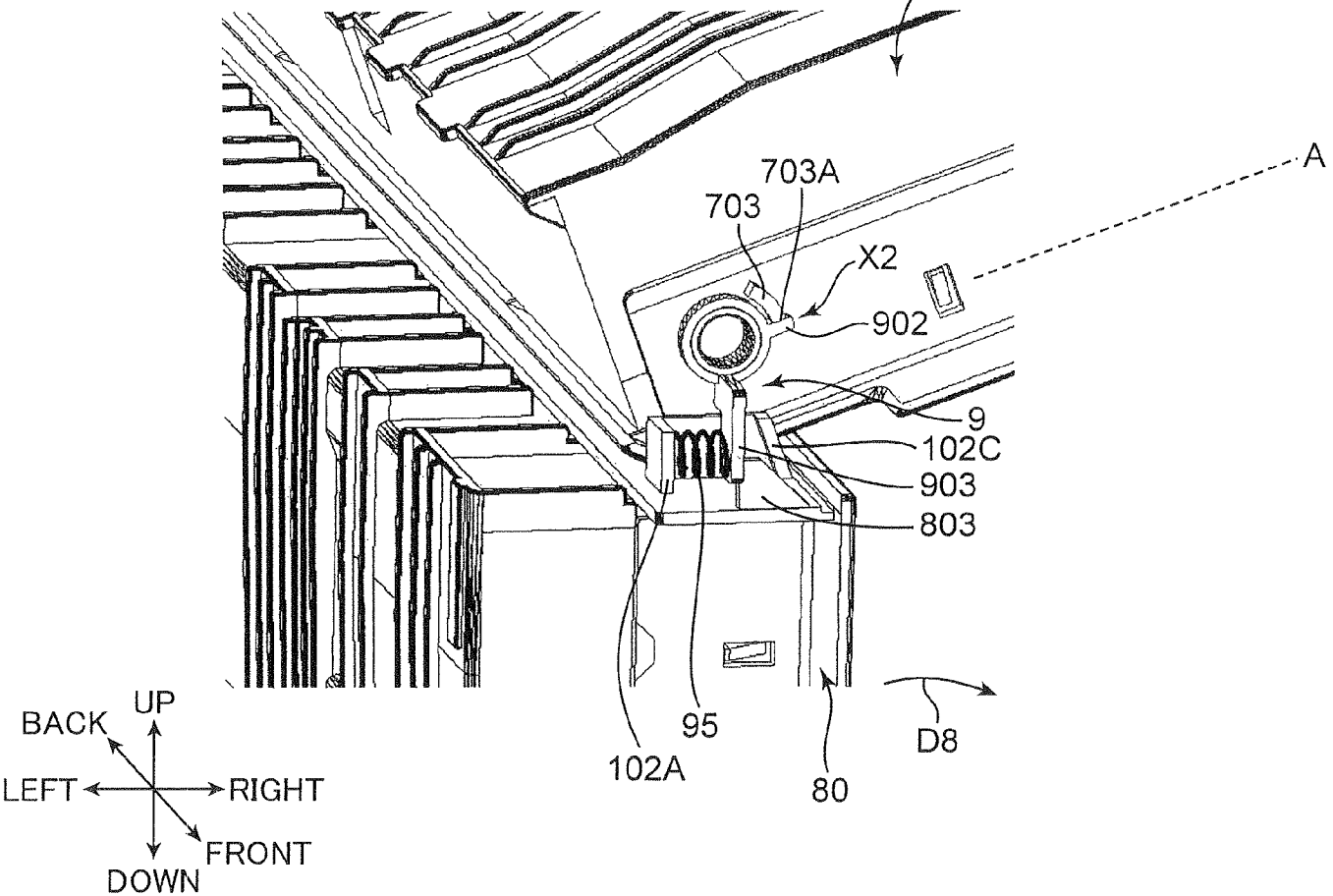
FIG. 8 is a perspective view showing the periphery of the restricting part when the upper door is in an open state and the lower door is in a closed state.
Figure 9:
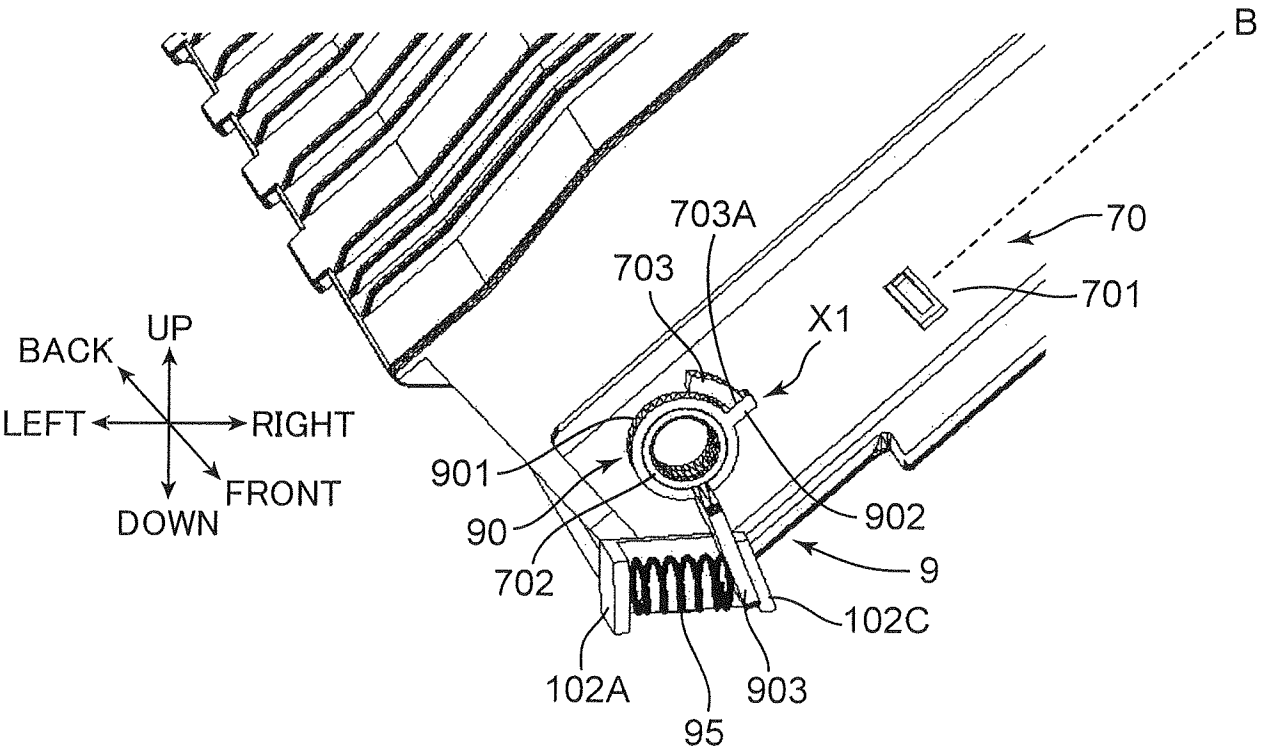
FIG. 9 is a perspective view showing the periphery of the restricting part when the upper door and the lower door are in an open state.

The open/close motion of the lower door 80 and the upper door 70 is now explained in further detail with reference to FIG. 8 and FIG. 9 in addition to FIG. 6. FIG. 8 is a perspective view showing the periphery of the restricting part 9 when the upper door 70 is in an open state and the lower door 80 is in a closed state. FIG. 9 is a perspective view showing the periphery of the restricting part 9 when the upper door 70 and the lower door 80 are in an open state.

In FIG. 6, the restricting member 90 is disposed at the second position X2 for turning around the upper turning axis 702. At the second position X2, the engaging piece 903 of the restricting member 90 is disposed downward. Here, the engaging piece 903 is biased rightward by the bias spring 95, and biased leftward by the contact piece 803 of the lower door 80. As described above, when the upper door 70 and the lower door 80 are in a closed state, the contact piece 803 fixes the position of the engaging piece 903 so that the engaging piece 903 is extended in the vertical direction in a state where the bias spring 95 is compressed between the left wall part 102A and the engaging piece 903. Consequently, the stopper 902 is disposed at a position that protrudes from the ring part 901 in a direction that is rightward and slightly upward.

In the foregoing closed state of the lower door 80; that is, in the state in which the restricting member 90 is disposed at the second position X2, let it be assumed that the operator opens the upper door 70. The upper door 70 turns around the shaft inserted into the upper turning axis 702. Consequently, with the position of the restricting member 90 still at the second position X2, the upper turning axis 702 and the protruding part 703 of the upper door 70 rotate in a clockwise direction. Eventually, the protrusion right end 703A, which is the right end of the protruding part 703, comes into contact with the stopper 902 at the second position X2, and the opening motion of the upper door 70 is stopped. Consequently, the upper door 70 becomes the state shown in FIG. 8. In this state, the upper door 70 is disposed at the position A of FIG. 4. To put it differently, the opening angle of the upper door 70 relative to the device body 10 corresponds to the angle θ2. Thus, the opening angle of the upper door 70 is maintained relatively wide, and the operator can favorably view the upward feeding path 70S.

When a sheet jam is not discovered in the upward feeding path 70S, the operator opens the lower door 80 from the state shown in FIG. 8 (arrow D8 of FIG. 8). Consequently, the contact piece 803 that was biasing the engaging piece 903 leftward while compressing the bias spring 95 is separated rightward from the engaging piece 903. Subsequently, the bias spring 95 is restored from the compressed state, and biases the engaging piece 903 rightward. Here, the restricting member 90 turns in a counterclockwise direction around the upper turning axis 702. Note that, in accordance with the turning of the restricting member 90, the stopper 902 presses the protruding part 703 leftward. Accordingly, the upper door 70 is moved in a direction of reducing the opening angle of the upper door 70.

Eventually, as shown in FIG. 9, the turning of the restricting member 90 is stopped by the engaging piece 903 coming into contact with the right wall part 102C in a state where the bias spring 95 is biasing the engaging piece 903 rightward. Consequently, the restricting member 90 is moved from the second position X2 to the first position X1. At the first position X1, the stopper 902 is disposed to protrude from the ring part 901 in a direction that is rightward and upward. In this embodiment, here, the stopper 902 is extended along an angle that is approximately 45 degrees relative to the horizontal line.

As a result of the restricting member 90 being disposed at the first position X1, the upper door 70 is disposed at the position B of FIG. 4 while the protruding part 703 of the upper door 70 is being supported by the stopper 902. To put it differently, the opening angle of the upper door 70 relative to the device body 10 is restricted to the angle θ1 (changes from the third opening angle to the second opening angle). Thus, the opening angle of the upper door 70 is maintained relatively small relative to the angle θ2, and the operator can favorably view the downward feeding path 80S without the operator's line of sight E being blocked.

Note that, when both the upper door 70 and the lower door 80 are in a closed state, even when the lower door 80 is opened first and the upper door 70 is opened subsequently, similar to the foregoing case, the opening angle of the upper door 70 is restricted to the angle θ1. In other words, as a result of the lower door 80 being opened first from the state shown in FIG. 6, the upper plate 802 is separated from the engaging piece 903. Thus, the restricting member 90 is turned with the upper door 70 still in a closed state, and the engaging piece 903 comes into contact with the right wall part 102C. Subsequently, the restricting member 90 is disposed at the first position X1. When the upper door 70 is opened from the foregoing state, the protruding part 703 of the upper door 70 comes into contact with the stopper 902 at the first position X1 (FIG. 9). Consequently, the upper door 70 is disposed at the position B of FIG. 4 at the first opening angle θ1.

According to this embodiment described above, when the lower door 80 is in a closed state, the upper door 70 becomes an open state relative to the device body 10 at the opening angle θ2. The operator can view the upward feeding path 70S via the space that was opened at the opening angle θ2. Meanwhile, when the lower door 80 is in an open state, the upper door 70 becomes an open state relative to the device body 10 at the opening angle θ1. The opening angle θ1 is smaller than the opening angle θ2. Thus, the upper door 70 is inhibited from blocking the operator's view of the downward feeding path 80S.

The restriction of the opening angle of the upper door 70 is performed in conjunction with the state changing operation between an open state and a closed state of the lower door 80 by the restricting part 9. The move part 91 moves the restricting member 90 to the first position X1 or the second position X2 in correspondence with an open state or a closed state of the lower door 80. The restricting member 90 comes into contact with the protruding part 703 of the upper door 70 at the first position X1 and restricts the opening angle of the upper door 70 to the angle θ1. Moreover, the restricting member 90 comes into contact with the protruding part 703 at the second position X2 and restricts the opening angle of the upper door 70 to the angle θ2. Thus, the opening angle of the upper door 70 is favorable changed according to the placement of the restricting member 90.

The restricting member 90 changes position between the first position X1 and the second position X2 upon turning around the rotating axis of the upper turning axis 702. When the lower door 80 is in a closed state, the contact piece 803 disposed on the lower door 80 comes into contact with the engaging piece 903 while compressing the bias spring 95. Consequently, the restricting member 90 is disposed at the second position X2. The opening angle of the upper door 70 is restricted to the angle θ2 by the protruding part 703 of the upper door 70 coming into contact with the stopper 902 at the second position X2.

Meanwhile, when the lower door 80 is in an open state, the contact piece 803 disposed on the lower door 80 is separated from the engaging piece 903. Thus, the engaging piece 903 is biased by the bias spring 95, and comes into contact with the right wall part 102C of the bracket 102. Consequently, the restricting member 90 is disposed at the first position X1. In addition, the opening angle of the upper door 70 is restricted to the angle θ1 by the protruding part 703 of the upper door 70 coming into contact with the stopper 902 at the first position X1. Accordingly, the restricting member 90 changes position between the first position X1 and the second position X2 based on the contact piece 803, the bias spring 95 and the bracket 102 in conjunction with the open/close motion of the lower door 80, and the opening angle of the upper door 70 is appropriately set.

When the upper door 70 is opened first and the lower door 80 is opened subsequently, the opening angle of the upper door 70 is changed from the angle θ2 to the angle θ1. Accordingly, even when the upper door 70 is opened first, the visibility of the downward feeding path 80S is maintained favorably.

Moreover, according to the foregoing embodiment, in the image forming apparatus 1 having the sheet feeding device 4 and the image forming unit 30, even when a sheet fed from the fourth sheet feeding cassette 40D is jammed on the downward feeding path 80S, or jammed across the downward feeding path 80S and the upward feeding path 70S, the visibility of the downward feeding path 80S is maintained favorably and the sheet can be easily removed. Thus, the time that the image forming operation is interrupted in the image forming unit 30 for the recovery operation of the sheet jam can be shortened as much as possible.

Second Embodiment

Figure 10:
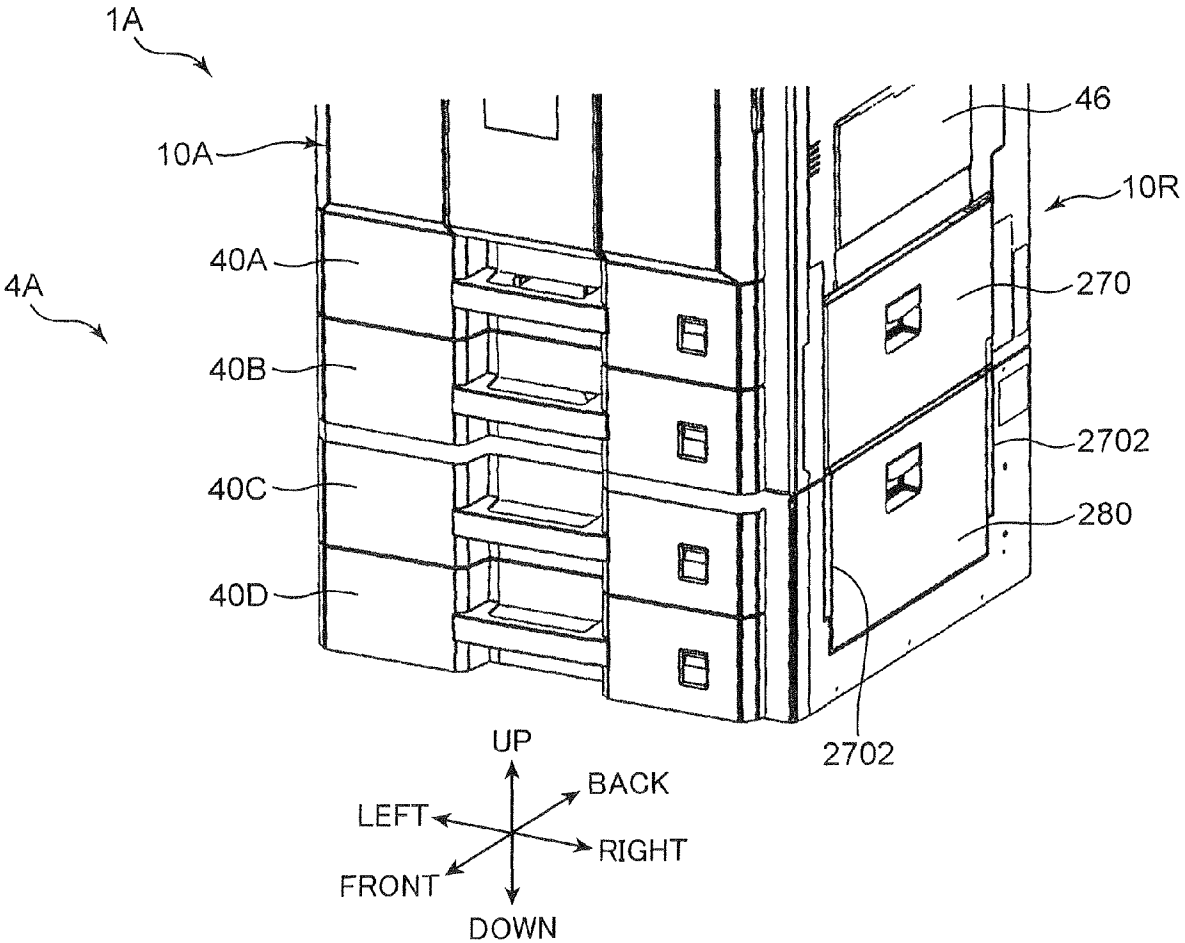
FIG. 10 is a partial perspective view of the image forming apparatus according to the second embodiment of the present disclosure.

FIG. 10 is a partial perspective view of the image forming apparatus 1A according to the second embodiment of the present disclosure. As with the image forming apparatus 1 of the first embodiment, the first sheet feeding cassette 40A, the second sheet feeding cassette 40B (second sheet loading part), the third sheet feeding cassette 40C (second sheet loading part) and the fourth sheet feeding cassette 40D (first sheet loading part) are mounted on the device body 10A in a manner so that the sheet feeding cassettes can be pulled toward the front side from the front. Including the area around the cassettes, since the internal structure of the device body 10A is substantially the same as the internal structure shown in FIG. 2, the explanation thereof is omitted.

The image forming apparatus 1A includes an upper door 270 (second cover) and a lower door 280 (first cover). The upper door 270 and the lower door 280 are disposed below the right side face 10R of the device body 10A. The upper door 270 and the lower door 280 are openable/closable relative to the device body 10A. What is different from the first embodiment is that the upper door 270 and the lower door 280 are opened and closed by turning around the rotating axis disposed coaxially.

Figure 11:
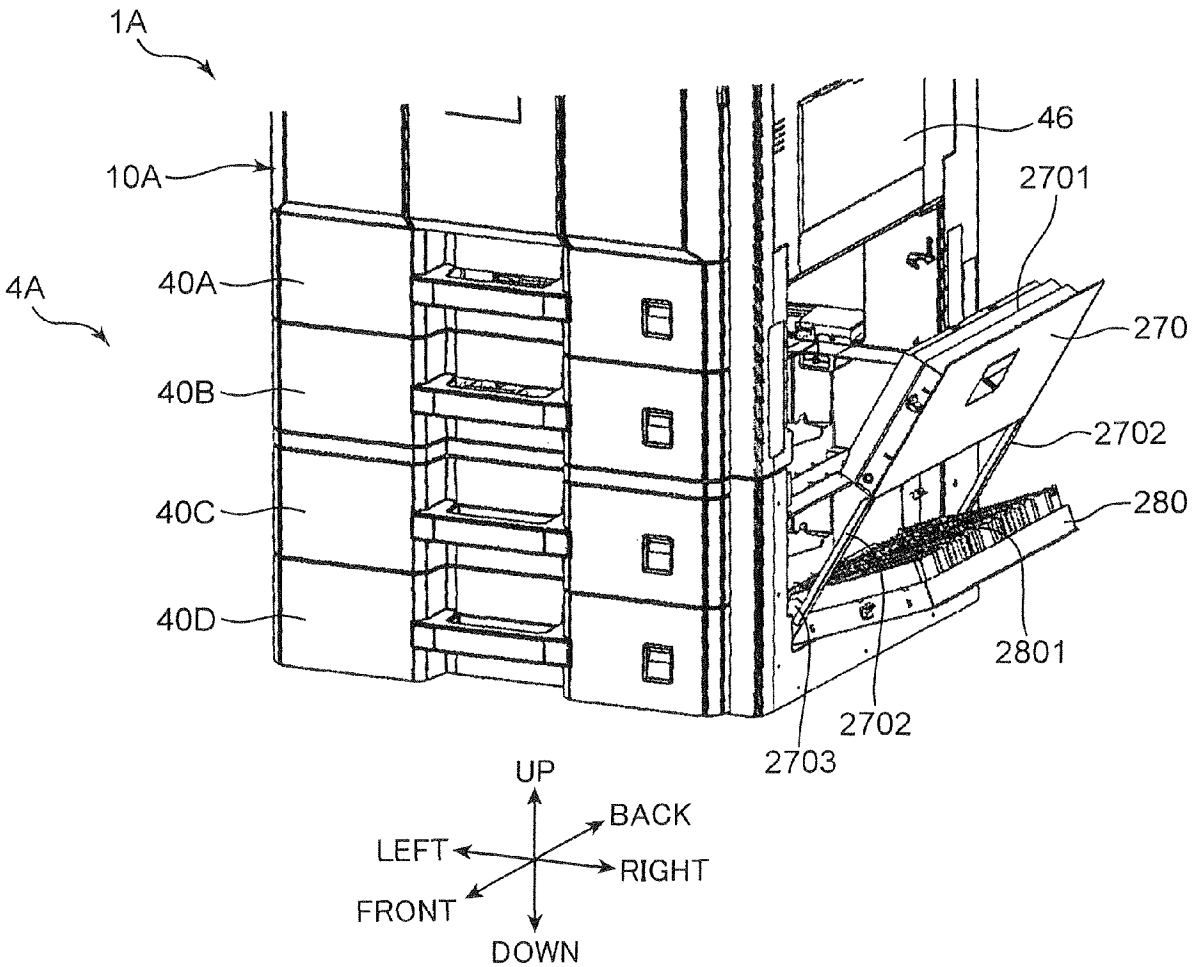
FIG. 11 is a perspective view of the image forming apparatus in which the upper door and the lower door are in an open state from the state shown in FIG. 10.

FIG. 11 is a perspective view of the image forming apparatus 1A when the upper door 270 and the lower door 280 become an open state from the state shown in FIG. 10. The upper portion of the upper door 270 is opened and closed against the device body 10A with the lower portion as the fulcrum. Similarly, the upper portion of the lower door 280 is also opened and closed against the device body 10A with the lower portion thereof as the fulcrum. When the upper door 270 is in an open state to the device body 10A (right side face 10R), the upward feeding path 70S (second feeding path; refer to FIG. 2) is exposed outside the device body 10A. Moreover, when the lower door 80 is in an open state to the device body 10 (right side face 10R), the downward feeding path 80S (first feeding path; refer to FIG. 2) is exposed outside the device body 10. As a result of the upper door 270 and the lower door 280 being opened and closed as described above, even when a sheet jam occurs in the upward feeding path 70S and the downward feeding path 80S, the operator can easily remove the sheet.

In the foregoing configuration, the sheet feeding device 4A (sheet feeding device) of the image forming apparatus 1A is configured from the first sheet feeding cassette 40A, the second sheet feeding cassette 40B, the third sheet feeding cassette 40C and the fourth sheet feeding cassette 40D, and the upward feeding path 70S, the upper door 270, the downward feeding path 80S, and the lower door 280.

Figure 12:
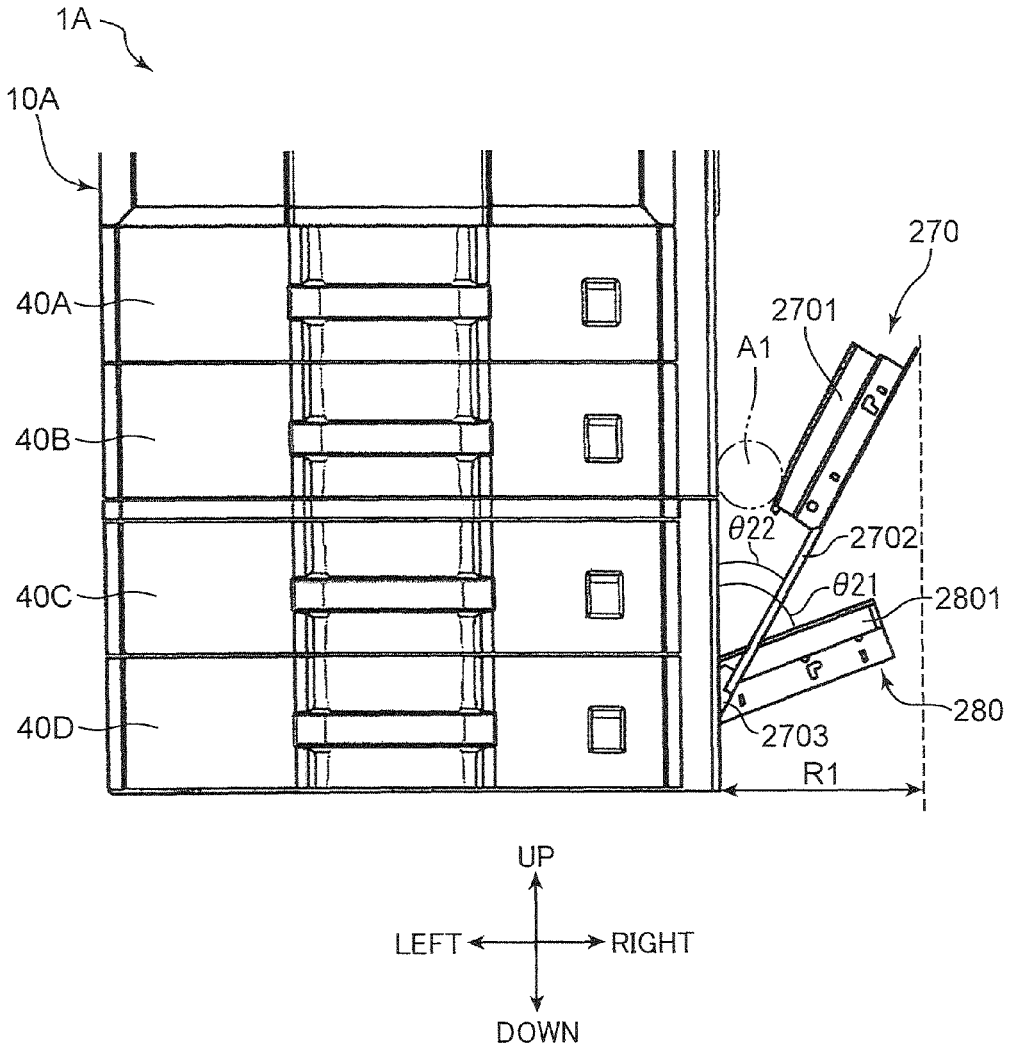
FIG. 12 is a front view of the image forming apparatus in the state shown in FIG. 11.
Figure 13:
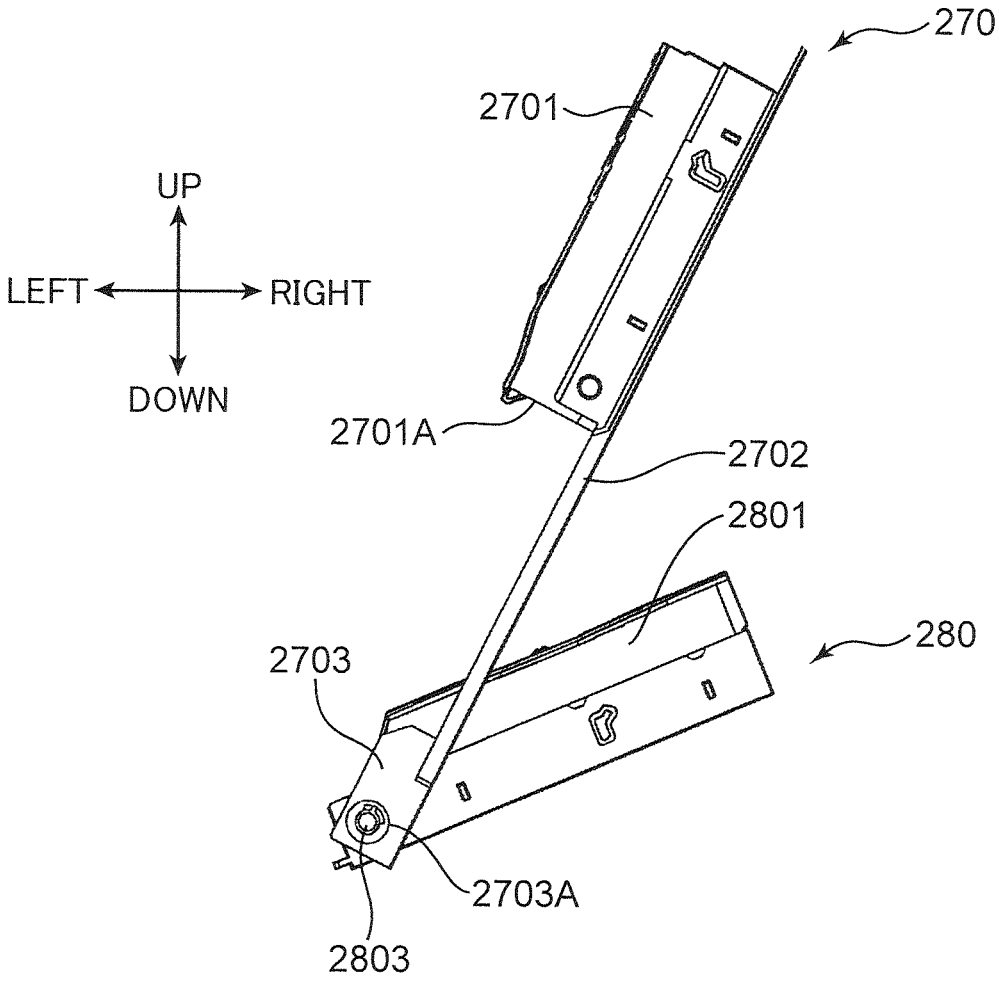
FIG. 13 is an enlarged view of the upper door and the lower door in FIG. 12.

The opening/closing modes of the upper door 270 and the lower door 280 are now explained with reference to FIG. 12 and FIG. 13 in addition to FIG. 11. FIG. 12 is a front view when the upper door 270 and the lower door 280 become an open state relative to the device body 10A, and FIG. 13 is a diagram showing only the upper door 270 and the lower door 280 in the state shown in FIG. 12.

Figure 24:
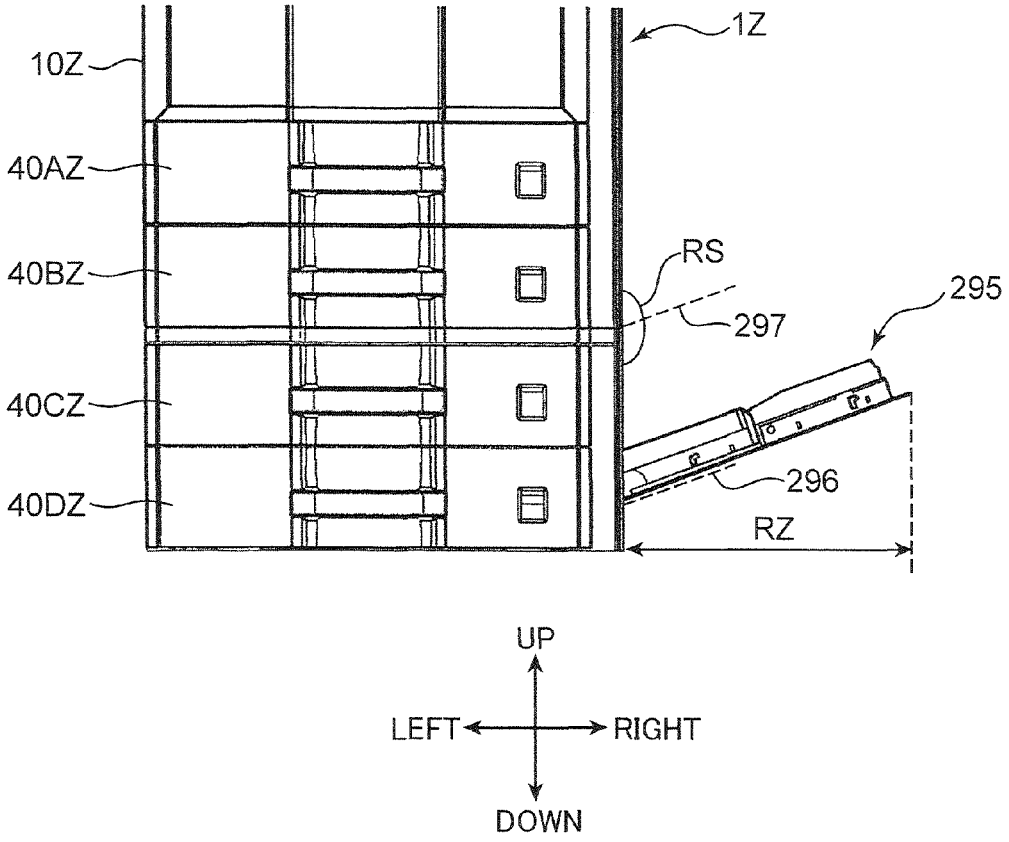
FIG. 24 is a front view of the image forming apparatus having the opening/closing door according to the comparative example.

Meanwhile, FIG. 24 is a front view of the image forming apparatus 1Z equipped with an integral cover 295 according to the comparative example relative to the second embodiment. With the image forming apparatus 1Z, as a result of the integral cover 295 becoming an open state to the device body 10Z, the supply path corresponding to the upward feeding path 70S and the downward feeding path 80S of this embodiment is simultaneously opened to the outside. In the foregoing case, the integral cover 295 is disposed across the four levels of sheet cassettes 40AZ, 40BZ, 40CZ, 40DZ. Thus, when the integral cover 295 is opened, the integral cover 295 is extended more rightward than the device body 10Z, and will occupy a broad open-close region RZ. To put it differently, a wide space around the image forming apparatus 1Z is required for the open/close motion of the integral cover 295.

Meanwhile, as with the first door 296 and the second door 297 shown with the dotted line in FIG. 24, considered may be disposing a plurality of opening/closing doors adjacent to the multiple levels of sheet cassettes. In the foregoing case, while the space occupied by the open/close motion of the opening/closing door can be reduced in comparison to the case of the integral cover 295, the sheet feeding path RS around the fulcrum of the second door 297 is not opened to the outside. Thus, the visibility of the sheet feeding path RS will deteriorate. In addition, when a sheet is jammed in a state of crossing the fulcrum, it will be difficult to remove the sheet.

In this embodiment, in order to resolve the foregoing problem, the sheet feeding device 4A and the image forming apparatus 1A having the same includes an upper door 270 and a lower door 280 which perform a unique open/close motion.

As shown in FIG. 13, the lower door 280 includes a lower body 2801 (first cover part) and a lower shaft 2803 (first rotating axis). The lower body 2801 is a body portion of the lower door 280, and has a function of covering the downward feeding path 80S. The lower shaft 2803 is a shaft that is disposed at the lower end on the side face of the lower body 2801 in the front-back direction. The upper side of the lower door 280 is opened to the device body 10A as a result of being turned around the lower shaft 2803.

The upper door 270 includes an upper body 2701 (second cover part) and an upper leg 2702. The upper body 2701 is a body portion of the upper door 270, and has a function of covering the upward feeding path 70S. The upper leg 2702 is a leg that extends downward from either ends of the upper body 2701 in the front-back direction, and reaches the lower shaft 2803. In the front-back direction (sheet width direction), the upper leg 2702 is disposed outside the downward feeding path 80S. The upper leg 2702 includes an upper support 2703. The upper support 2703 is a pair of plate-shaped members disposed at the lower end of the upper leg 2702 facing the front-back direction.

The upper support 2703 includes an upper shaft 2703A (second rotating axis). The upper shaft 2703A is externally fitted into the lower shaft 2803 of the lower door 280 which is a hole that is opened at the lower end of the upper support 2703. The upper shaft 2703A serves as the rotating axis in the open-close motion of the upper door 270. With regard to the placement of the upper shaft 2703A; to put it differently, the upper shaft 2703A is disposed outside the downward feeding path 80S in a sheet width direction (front-back direction) which intersects with the sheet feeding direction of the upward feeding path 70S and below the upper edge of the lower door 280 in a closed state. Subsequently, the upper side of the upper door 270 is opened and closed against the device body 10A (right side face 10R) by the upper door 270 turning around the upper shaft 2703A.

As described above, the upper door 270 is turned around the upper shaft 2703A disposed below the upper edge of the lower door 280 in a closed state. Thus, in accordance with the opening of the upper door 270, the lower edge of the upper body 2701 of the upper door 270 is separated from the housing (area A1 of FIG. 12). Consequently, the upper end of the downward feeding path 80S and the lower end of the upward feeding path 70S are favorably exposed outside the device body 10A. Thus, even when the sheet S is jammed across the upward feeding path 70S and the downward feeding path 80S, the operator can easily remove the sheet S. In particular, with this embodiment, the upper shaft 2703A of the upper door 270 is disposed coaxially with the lower shaft 2803 of the lower door 280. Thus, even when the upper door 270 is opened at the same angle as the lower door 280, the upper door 270 is opened up to a position that is separated as much as possible from the device body 10A. Consequently, the visibility of the upward feeding path 70S becomes favorable.

In this embodiment, when both the upper door 270 and the lower door 280 are in an open state, the upper door 270 and the lower door 280 respectively become an open state relative to the device body 10A in a mode where the opening angle of the upper door 270 relative to the device body 10A (right side face 10R) is smaller than the opening angle of the lower door 280 relative to the device body 10A (right side face 10R).

Figure 22:
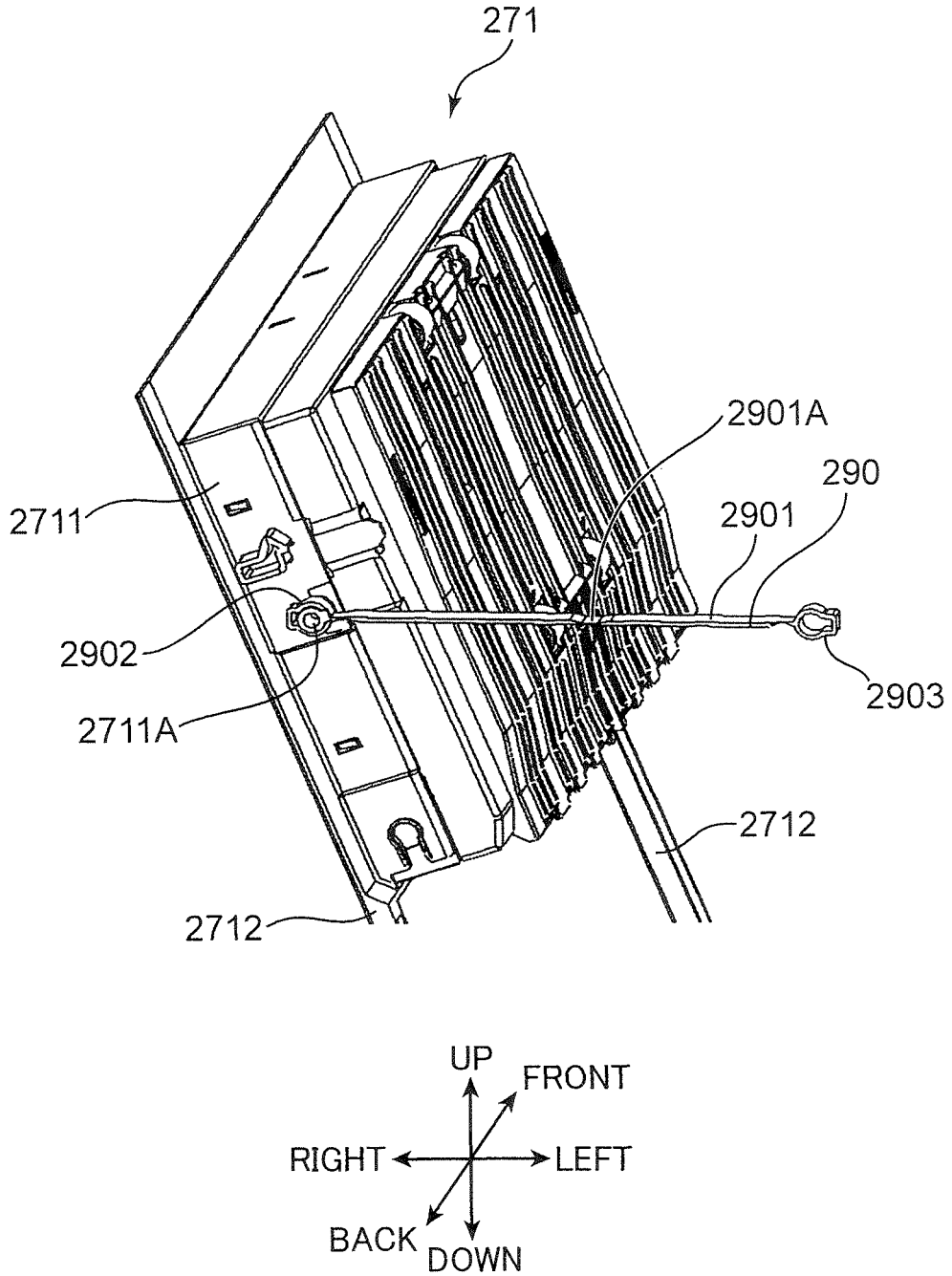
FIG. 22 is a perspective view showing the appearance of the upper door in the state shown in FIG. 20.
Figure 23:
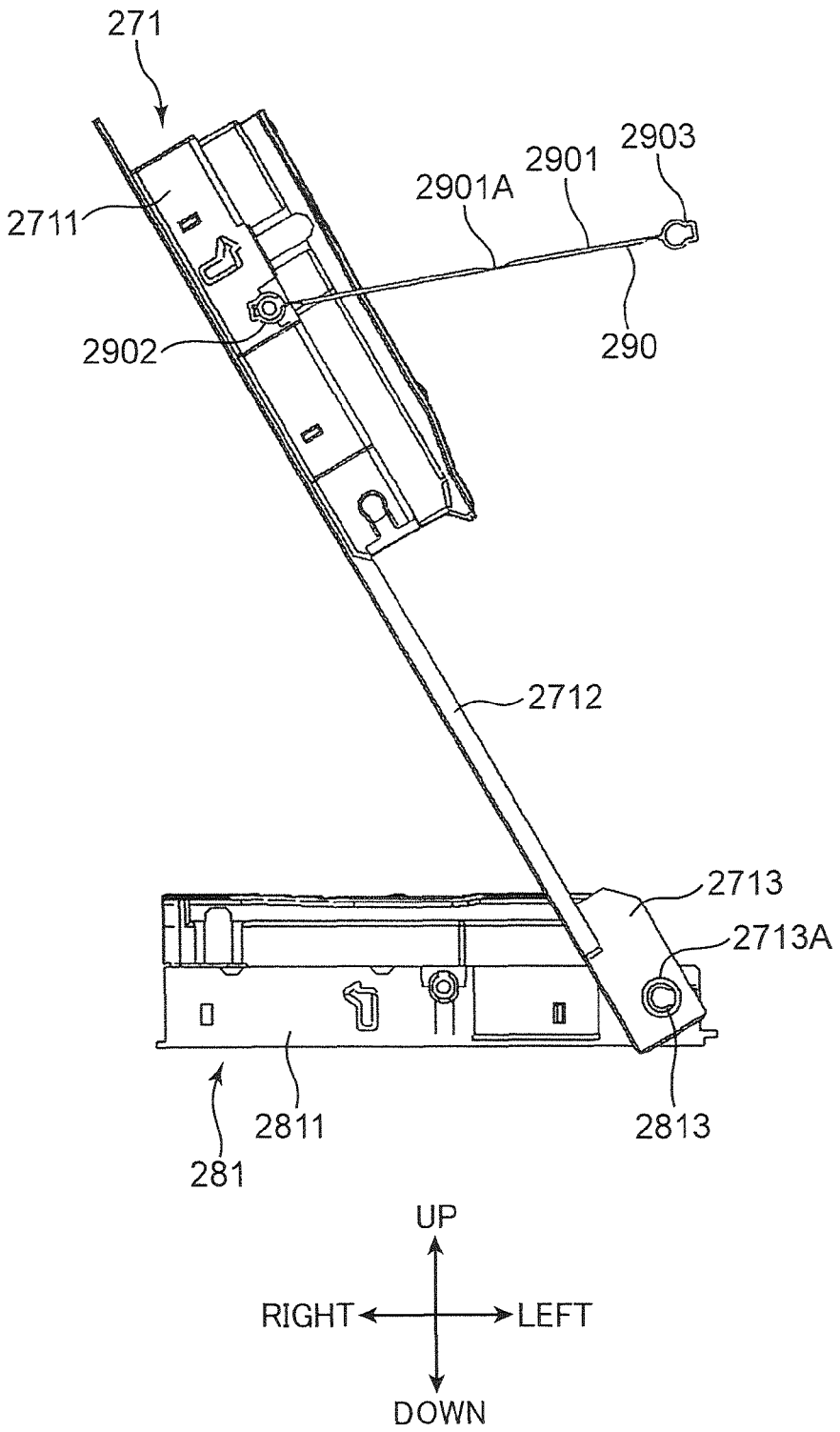
FIG. 23 is a diagram viewing, from the opposite direction, the upper door and the lower door in the state shown in FIG. 20.

In other words, as shown in FIG. 12, the angle θ22 in which is an opening angle (second opening angle) when the upper door 270 is in an open state to the device body 10A is set to be smaller than the angle θ21 which is an opening angle (first opening angle) when the lower door 280 is in an open state to the device body 10A. Note that a strap not shown is mounted between the upper door 270 and the device body 10A, and the length of the strap is defined in advance so that the opening angle of the upper door 270 becomes the angle θ22. Similarly, a strap not shown is mounted between the lower door 280 and the device body 10A, and the length of the strap is defined in advance so that the opening angle of the lower door 280 becomes the angle θ21 (note that the configurations of the strap are illustrated in FIG. 22 and FIG. 23).

As a result of the opening angle θ22 of the upper door 270 being set to be smaller than the opening angle θ21 of the lower door 280 as described above, the open-close region R1 shown in FIG. 12 becomes narrower than the open-close region RZ of FIG. 24. In other words, in comparison to the case of exposing the upward feeding path 70S and the downward feeding path 80S to the outside with one cover 295, the space that is occupied by the opening motion of the upper door 270 and the lower door 280 can be reduced.

Figure 14:
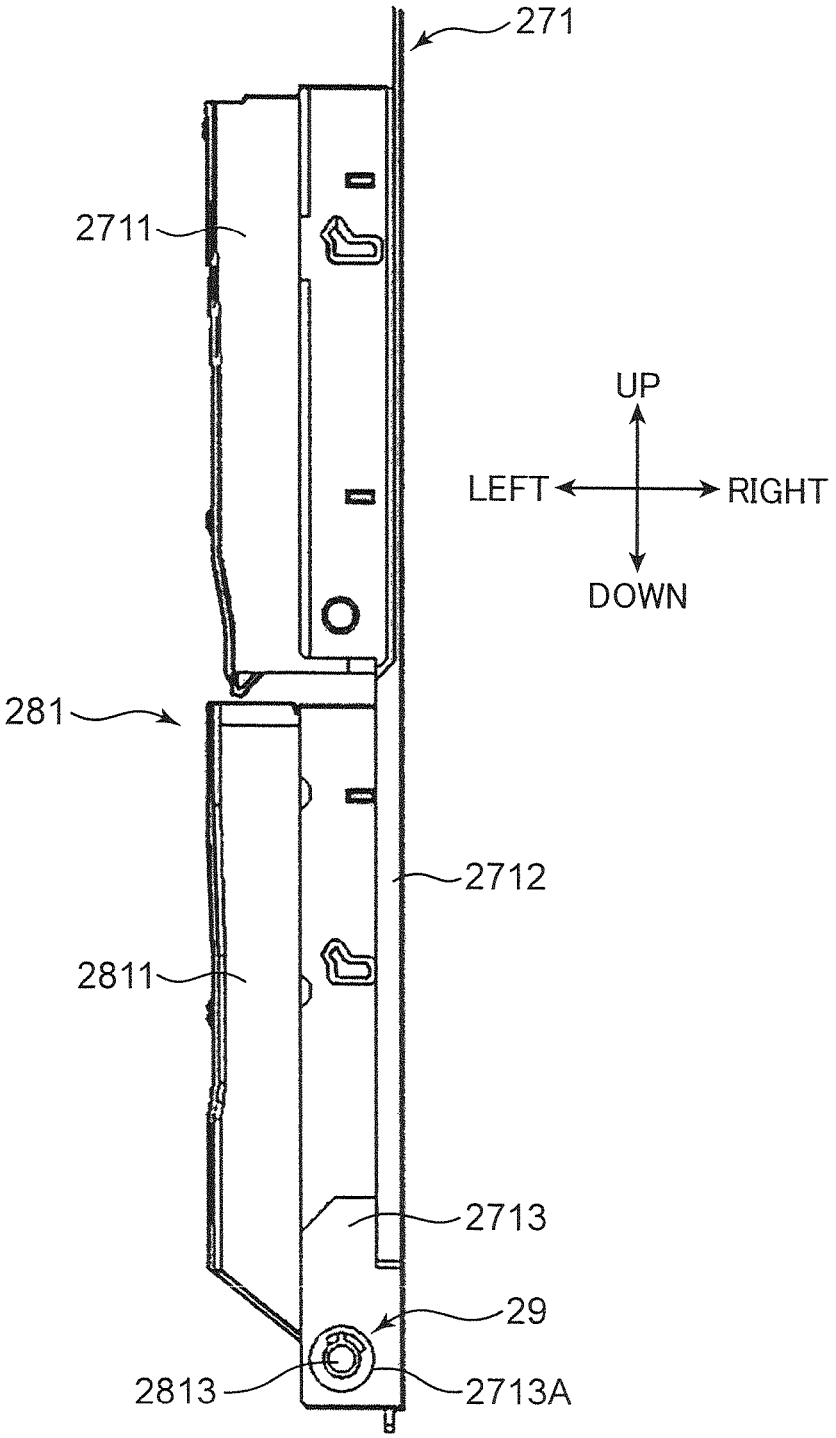
FIG. 14 is a front view showing the appearance of the closed state of the upper door and the lower door in a modified embodiment of the second embodiment.
Figure 15:
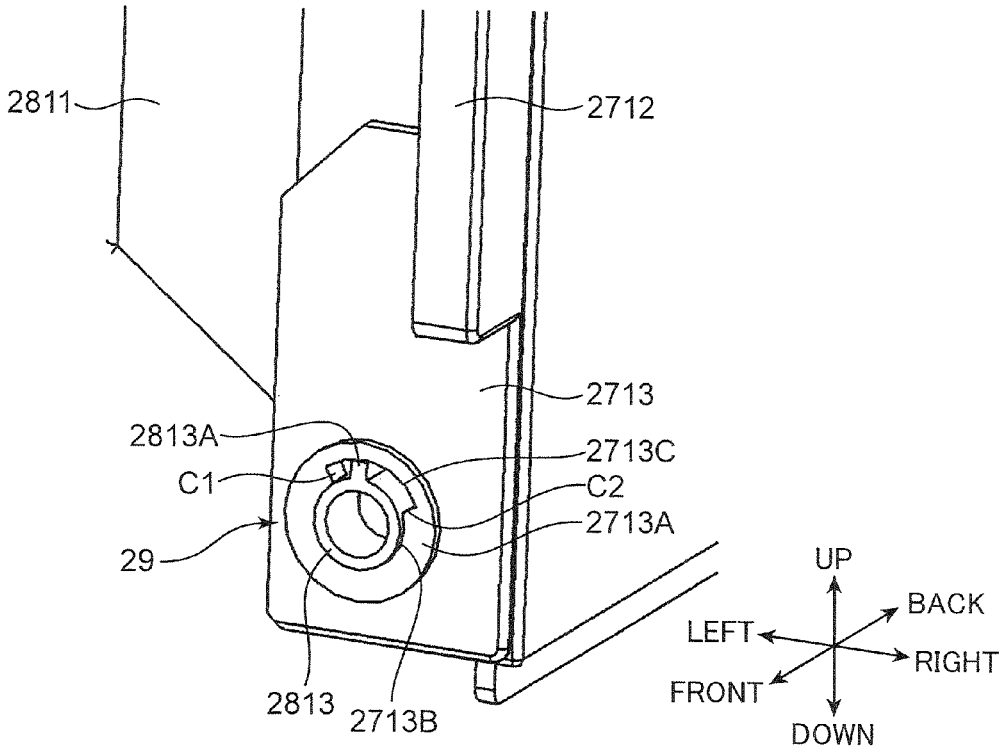
FIG. 15 is an exploded perspective view showing the turning fulcrum of the upper door and the lower door in the state shown in FIG. 14.
Figure 16:
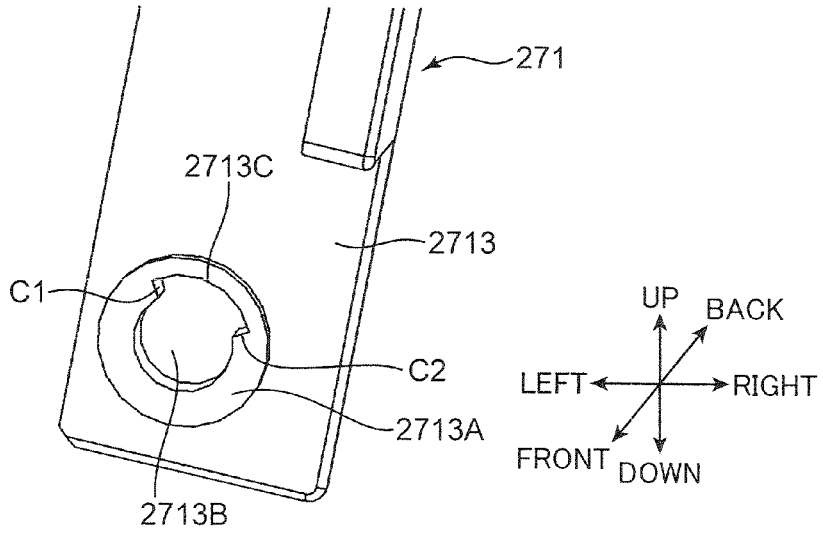
FIG. 16 is an exploded perspective view showing the turning fulcrum of the upper door in FIG. 15.
Figure 17:
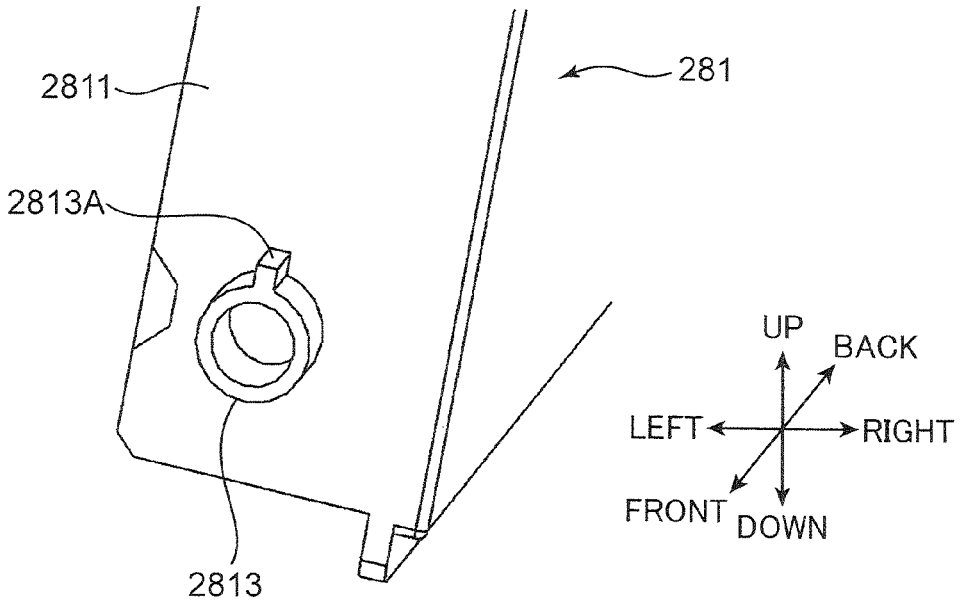
FIG. 17 is an exploded perspective view showing the turning fulcrum of the lower door in FIG. 15.

The upper door 271 (second cover) and the lower door 281 (first cover) according to a modified embodiment of the foregoing second embodiment are now explained. FIG. 14 is a front view showing the appearance of the upper door 271 and the lower door 281 in a closed state according to the modified embodiment. In FIG. 14, the illustration of the device body 10A is omitted. FIG. 15 is an exploded perspective view showing the interlocking part 29 as the turning fulcrum of the upper door 271 and the lower door 281 in the state shown in FIG. 14. FIG. 16 is an exploded perspective view showing the side of the upper door 271 in FIG. 15, and FIG. 17 is an exploded perspective view showing the side of the lower door 281 in FIG. 15.

The upper door 271 and the lower door 281 have the same basic structure as the upper door 270 and the lower door 280 described above. What is different is that, when the upper door 271 is in a closed state, the opening angle (first opening angle) of the lower door 281 relative to the device body 10A is an angle θ23 (first angle θA) (refer to FIG. 18), and, when the upper door 271 is in an open state, the opening angle (first opening angle) of the lower door 281 relative to the device body 10A is a second angle θ24 (second angle θB) that is greater than the angle θ23 (refer to FIG. 20). In addition, the modified embodiment is unique in that the upper door 271 and the lower door 281 includes an interlocking part 29. The interlocking part 29 has a function of changing the opening angle of the lower door 281 relative to the device body 10A from the angle θ23 to the angle θ24 in conjunction with the change from a closed state to an open state of the upper door 271.

As with the lower door 280, the lower door 281 includes a lower body 2811 (first cover part), and a lower shaft 2813 (cylindrical part; first rotating axis). The lower body 2811 is a body portion of the lower door 281, and has a function of covering the downward feeding path 80S. The lower shaft 2813 is a cylindrical member that is installed in a protruding manner from the lower end of the side face of the lower body 2811 in the front-back direction toward the sheet width direction (front-back direction). As a result of a shaft not shown disposed on the device body 10A being inserted through the lower shaft 2813, the lower shaft 2813 functions as a turning axis in the turning of the lower door 281. In other words, as a result of the lower door 281 being turned around the lower shaft 2813, the upper side of the lower door 281 is opened and closed relative to the device body 10A.

As with the upper door 270, the upper door 271 includes an upper body 2711 (second cover part) and an upper leg 2712. The upper body 2711 is a body portion of the upper door 271, and has a function of covering the upward feeding path 70S. The upper leg 2712 is a leg that extends downward from either ends of the upper body 2711 in the front-back direction, and reaches the lower shaft 2813. In the front-back direction (sheet width direction), the upper leg 2712 is disposed outside the downward feeding path 80S. The upper leg 2712 includes an upper support 2713. The upper support 2713 is a pair of plate-shaped members disposed at the lower end of the upper leg 2712 facing the front-back direction.

The upper support 2713 includes an upper shaft 2713A (second rotating axis). The upper shaft 2713A is a portion to serve as the rotating axis in the turning of the upper door 271. The upper shaft 2713A includes a hole 2713B. The hole 2713B is an opening that is opened in a circular shape in the upper shaft 2713A. When the upper support 2713 is disposed outside the lower body 2811, the lower shaft 2813 of the lower door 281 is inserted through the hole 2713B. As a result of the lower shaft 2813 being inserted through the hole 2713B, the upper shaft 2713A is disposed coaxially with the lower shaft 2813. As a result of the upper door 271 turning around the upper shaft 2713A, the upper side of the upper door 271 is opened and closed against the device body 10A (right side face 10R).

The lower door 281 additionally includes a protruding part 2813A (FIG. 15 and FIG. 17). The protruding part 2813A is a protruding member that is installed in a manner of protruding from the outer peripheral portion of the lower shaft 2813 in a radial direction (outer radial side of the cylindrical lower shaft 2813) in the rotation of the lower door 281. Moreover, the upper door 271 includes a guide groove 2713C (guide part) (FIG. 15 and FIG. 16). The guide groove 2713C is a notch that is cut in the upper support 2713 from the hole 2713B toward the radial direction with a predetermined width in a peripheral direction in the rotation of the upper door 271; that is, a notch that expands a part of the hole 2713B to the outer radial side.

When the lower shaft 2813 is inserted through the hole 2713B, the protruding part 2813A is inserted into the guide groove 2713C and movement in the peripheral direction is enabled. Note that the upper support 2713 includes a groove left end C1 (first wall part) and a groove right end C2 (second wall part). The groove left end C1 demarcates the upstream end of the guide groove 2713C in a rotating direction of opening the upper door 271. The groove right end C2 demarcates the downstream end of the guide groove 2713C in a rotating direction of the upper door 271.

A strap 290 (restricting member) is disposed between the upper door 271 and the device body 10A (FIG. 22 and FIG. 23). The strap 290 has a function of restricting the opening angle of the upper door 271 relative to the device body 10A. The strap 290 is a strap-shaped member configured from a resin material, and includes a support 2901, a door fixing part 2902, and a body fixing part 2903. The support 2901 is a body portion of the strap 290. The support 2901 has a bent part 2901A. The bent part 2901A is a portion in which the thickness of the substantial center of the support 2901 in the longitudinal direction is formed partially thin. The door fixing part 2902 is disposed at one end of the support 2901, and is formed as a ring shape. The door fixing part 2902 engages with a protruding part 2711A that is installed in a protruding manner to the side face on the rear side of the upper body 2711 of the upper door 271. The body fixing part 2903 is disposed at the other end of the support 2901, and is formed as a ring shape. The body fixing part 2903 engages with a protruding part not shown that is disposed on the device body 10.

Figure 20:
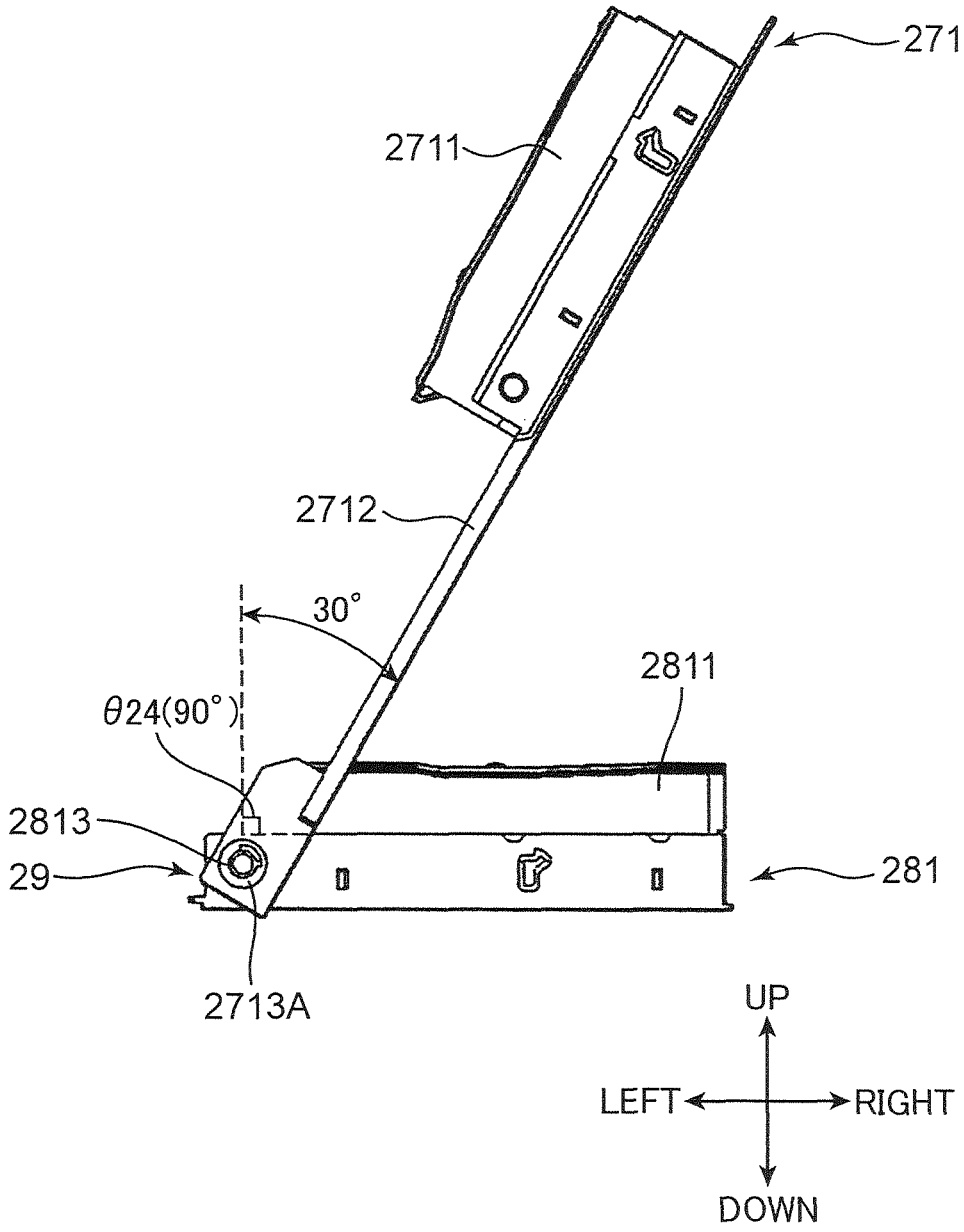
FIG. 20 is a front view showing the appearance of the open state of the upper door and the lower door.

With the upper door 271 in a closed state, the strap 290 is bent and placed across the upper door 271 and the device body 10A by the bent part 2901A being bent. Moreover, when the upper door 271 is released, the bend of the bent part 2901A is extended, and the opening angle of the upper door 271 relative to the device body 10A is thereafter restricted by the strap 290. In this embodiment, the opening angle of the upper door 271 is set to 30 degrees (FIG. 20).

Figure 18:
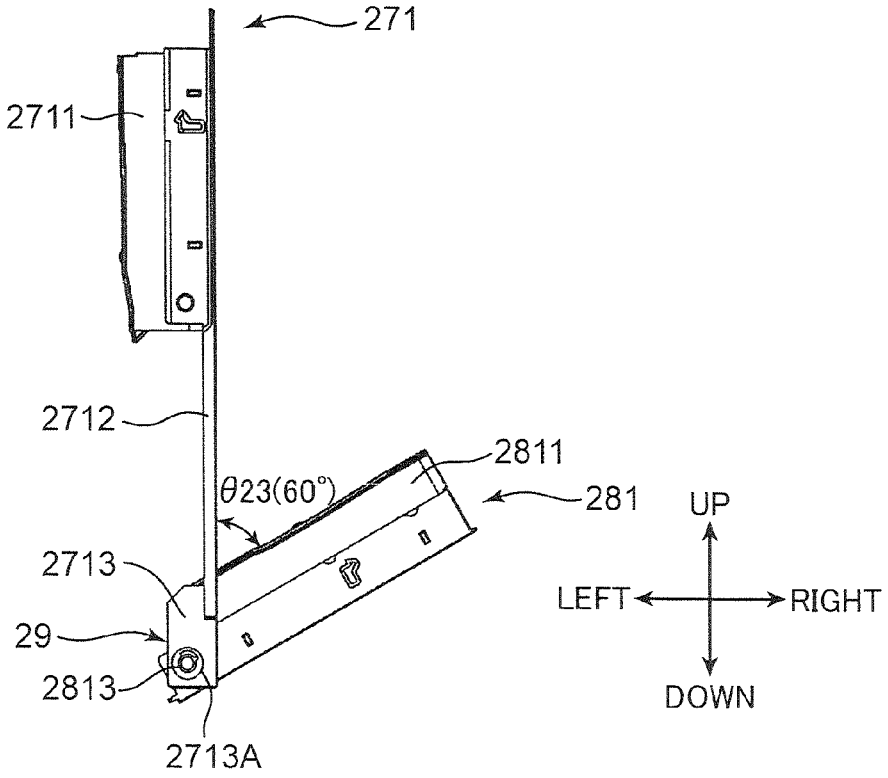
FIG. 18 is a front view showing the appearance of the closed state of the upper door and the open state of the lower door in the modified embodiment.
Figure 19:
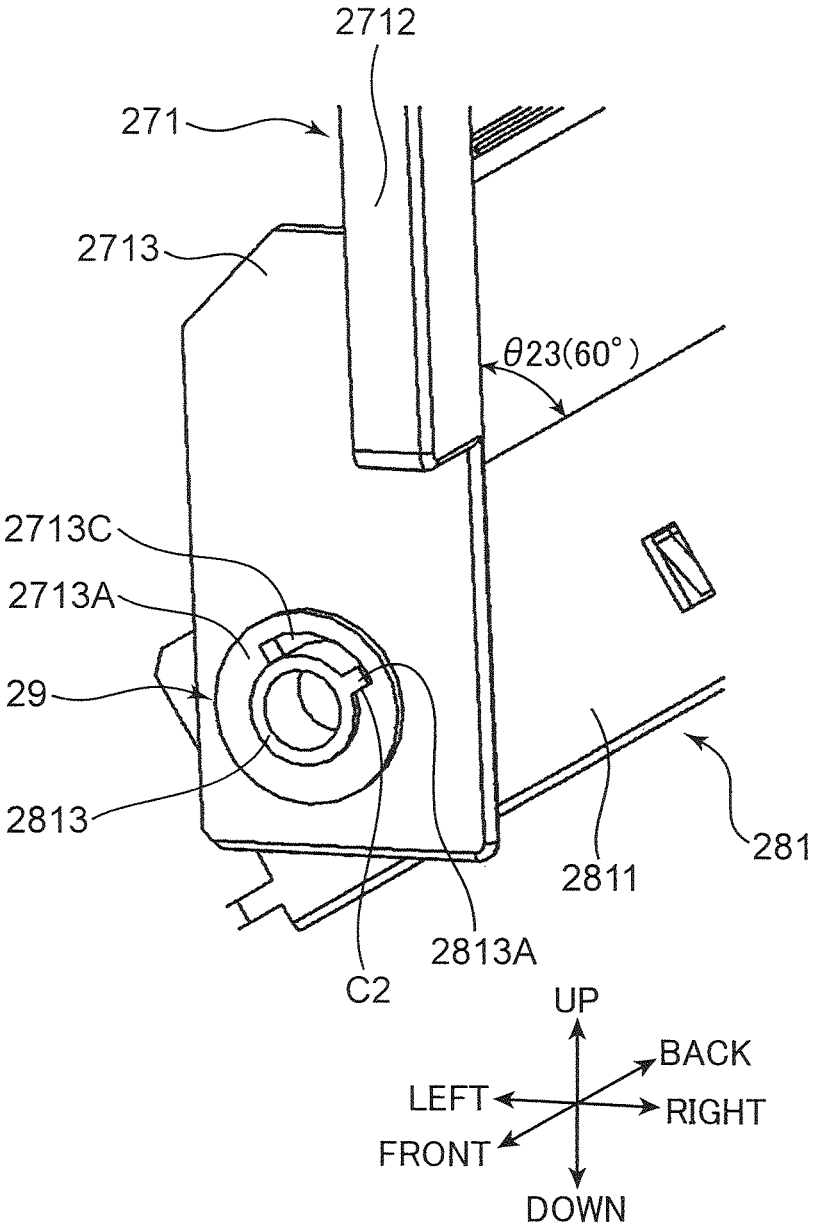
FIG. 19 is an exploded perspective view showing the turning fulcrum of the upper door and the lower door in the state shown in FIG. 18.
Figure 21:
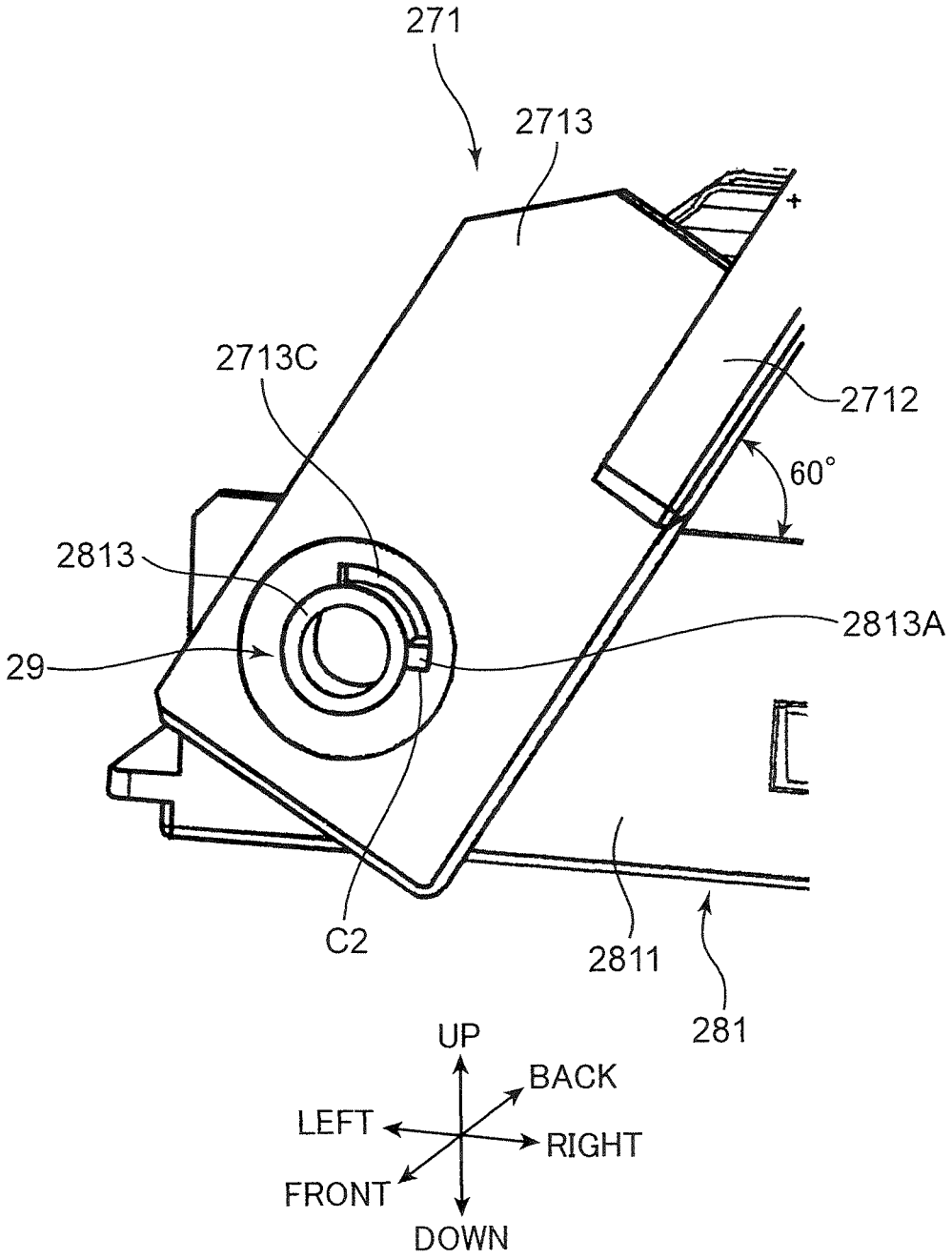
FIG. 21 is an exploded perspective view showing the turning fulcrum of the upper door and the lower door in the state shown in FIG. 20.

The open/close motion of the upper door 271 and the lower door 281 is now explained in detail with reference to FIG. 18 to FIG. 23 in addition to FIG. 14 and FIG. 15. FIG. 18 is a front view showing the appearance of the upper door 271 in a closed state and the lower door 281 in an open state in this modified embodiment, and FIG. 19 is an exploded perspective view showing the periphery of the interlocking part 29 of the upper door 271 and the lower door 281 in the state shown in FIG. 18. FIG. 20 is a front view showing the appearance of the open state of the upper door 271 and the lower door 281, and FIG. 21 is an exploded perspective view showing the periphery of the interlocking part 29 of the upper door 271 and the lower door 281 in the state shown in FIG. 20. FIG. 22 is a perspective view showing the appearance of the upper door 271 in the state shown in FIG. 20, and FIG. 23 is a diagram viewing, from the opposite direction, the upper door 271 and the lower door 281 in the state shown in FIG. 20.

With reference to FIG. 14 and FIG. 15, the protruding part 2813A is disposed between the groove left end C1 and the groove right end C2 of the guide groove 2713C when the upper door 271 and the lower door 281 are in a closed state. When the lower door 281 is opened from the foregoing state while the upper door 271 is still closed, the protruding part 2813A eventually comes into contact with the groove right end C2 of the guide groove 2713C. Consequently, as shown in FIG. 18 and FIG. 19, the opening motion of the lower door 281 is stopped. Here, the opening angle of the lower door 281 is restricted to the angle θ23 (first angle θA). In this embodiment, the opening angle θ23 is set to 60 degrees. The operator can use the released space and thereby access the downward feeding path 80S.

In addition, when the upper door 271 is released from the state shown in FIG. 18 and FIG. 19, the upper door 271 and the lower door 281 turn integrally with the protruding part 2813A of the lower door 281 in a state of being supported by the groove right end C2 of the upper door 271. Subsequently, by the upper door 271 being pulled by the strap 290 (FIG. 22), the opening motion of the upper door 271 and the lower door 281 is stopped. Consequently, as shown in FIG. 20, the opening angle of the lower door 281 is changed from the angle θ23 to the angle θ24 (second angle θB). In this embodiment, the opening angle θ24 is set to 90 degrees.

The operator can use the space that was released by the upper door 271, and thereby access the upward feeding path 70S. Moreover, since the lower end of the upper body 2711 of the upper door 271 is separated from the device body 10A, the operator can also access the downward feeding path 80S from between the upper body 2711 and the device body 10A. In addition, as a result of the opening angle of the lower door 281 being expanded in response to the opening of the upper door 271, the operator can also access the downward feeding path 80S from between the upper door 271 and the lower door 281. To put it differently, the narrowing of the space for the lower door 281 to expose the downward feeding path 80S can be inhibited in response to the opening motion of the upper door 271.

Meanwhile, with reference to FIG. 14, FIG. 15 and FIG. 20, when the upper door 271 is opened with the lower door 281 in a closed state, the opening angle of the upper door 271 is restricted by the strap 290. Here, the guide groove 2713C of the upper door 271 is turned in a clockwise direction without the protruding part 2813A of the lower door 281 moving. In addition, the groove left end C1 of the upper support 2713 comes into contact with the protruding part 2813A simultaneously with the strap 290 stopping the opening motion of the upper door 271. Thus, the opening motion of the upper door 271 is also stopped by the protruding part 2813A of the lower door 281. Note that the protruding part 2813A of the lower door 281 in a closed state and the groove left end C1 of the upper door 271 in a closed state are separated 30 degrees in correspondence with the opening angle of the upper door 271.

According to the foregoing second embodiment, the upward feeding path 70S is exposed outside the device body 10A as a result of the upper door 270 (upper door 271) being opened. Moreover, the downward feeding path 80S is also exposed outside the device body 10A as a result of the lower door 280 (lower door 281) being opened. Here, the upper door 270 is turned around the upper shaft 2703A disposed below the upper edge of the lower door 280 in a closed state. Thus, in response to the opening of the upper door 270, the lower edge of the upper body 2701 of the upper door 270 is separated from the device body 10A. Consequently, the upper end of the downward feeding path 80S and the lower end of the upward feeding path 70S will be favorably exposed outside the device body 10A.

Consequently, even when the sheet is jammed across the upward feeding path 70S and the downward feeding path 80S, the operator can easily remove the sheet. In addition, the opening angle θ22 of the upper door 70 in an open state is set to be smaller than the opening angle θ21 relative to the device body 10A when the lower door 280 is in an open state. Thus, in comparison to the case of exposing the upward feeding path 70S and the downward feeding path 80S to the outside with one cover, the space that is occupied by the opening motion of the upper door 270 and the lower door 280 can be reduced. Accordingly, the space that is occupied around the sheet feeding device 4A and the image forming apparatus 1A can be reduced as much as possible.

The upper shaft 2703A of the upper door 270 is disposed coaxially with the lower shaft 2803 in the upper leg 2702 that is extended from the upper body 2701. Thus, even when the upper door 270 is opened at the same angle as the lower door 280, the upper door 270 is opened up to a position that is separated as much as possible from the device body 10A. Consequently, the visibility of the upward feeding path 70S becomes favorable.

Moreover, in the modified embodiment, when the upper door 271 is opened, the lower door 281 is opened at the opening angle θ24 that is greater than the opening angle θ23. Accordingly, as a result of the upper door 271 being opened, the narrowing of the space for exposing the downward feeding path 80S can be inhibited.

Moreover, the opening angle of the lower door 281 can be favorably changed by the interlocking part 29. In particular, when the lower door 281 is opened with the upper door 271 in a closed state, the opening angle of the lower door 281 is restricted to the angle θ23 by the protruding part 2813A coming into contact with the groove right end C2. The opening angle of the lower door 281 is changed from the angle θ23 to the angle θ24 in conjunction with the opening motion of the upper door 271. Moreover, when the upper door 271 is opened with the lower door 281 in a closed state, the opening angle of the upper door 271 can be restricted to a favorable angle by the groove left end C1 coming into contact with the protruding part 2813A.

The sheet feeding devices 4, 4A according to the embodiments of the present disclosure and the image forming apparatuses 1, 1A including the same were explained above, but the present disclosure is not limited thereto. For example, the present disclosure may also adopt the following modified embodiments.

(1) In the first and second embodiments described above, while the sheet feeding part 40 was explained as a mode of having a four-level sheet feeding cassette, the present disclosure is not limited thereto. The mode also may be such that sheets are fed to the upward feeding path 70S from the second sheet feeding cassette 40B, and the sheets are fed to the downward feeding path 80S from the fourth sheet feeding cassette 40D. In addition, the mode may also be such that the upward feeding path 70S and the downward feeding path 80S are feeding paths for transferring the sheets in the vertical direction, and to which sheets are not directly fed. In other words, when using a large sheet loading device which loads numerous sheets in which the feeding path from the sheet loading part to the image forming unit is set long, the foregoing upward feeding path 70S, the downward feeding path 80S, the upper door 70, and the lower door 80 may be applied to the feeding path on which the sheets are fed in the vertical direction.

(2) In the first embodiment, illustrated was a mode in which the opening angle (third opening angle) of the upper door 70 and the opening angle of the lower door 80 when the lower door 80 is in a closed state are the same angle (θ2). The opening angle of the upper door 70 when the lower door 80 is in a closed state will suffice so as long as it is greater than the opening angle (second opening angle) of the upper door 70 when the lower door 80 is in an open state, and may be an angle that is different from the opening angle (first opening angle) of the lower door 80.

(3) In the second embodiment, illustrated was a mode where the upper shaft 2703A, which is the rotating axis of the upper door 270, is disposed coaxially with the lower shaft 2813, which is the rotating axis of the lower door 280. However, the present disclosure is not limited thereto, and the mode will suffice so as long as the upper shaft 2703A is disposed lower than the upper edge of the lower door 280.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding device, comprising:

a housing;

a first feeding path extending in a vertical direction within the housing and on which a sheet is fed;

a second feeding path extending in the vertical direction within the housing and in which a lower end thereof is connected to an upper end of the first feeding path and on which a sheet is fed;

a first cover an upper side of which is openable/closable relative to the housing with a lower side as a fulcrum, and, in an open state, exposes the first feeding path outside of the housing;

a second cover an upper side of which is openable/closable relative to the housing with a lower side as a fulcrum, and, in an open state, exposes the second feeding path outside of the housing; and a restricting part that restricts an opening angle of the second cover, wherein when both the first cover and the second cover are in the open state, the first cover and the second cover are respectively in the open state relative to the housing in a mode where a second opening angle of the second cover relative to the housing is smaller than a first opening angle of the first cover relative to the housing and when the first cover is in a closed state, the second cover is in the open state relative to the housing at a third opening angle that is greater than the second opening angle, and the restricting part restricts the opening angle of the second cover to the second opening angle or the third opening angle in conjunction with a state changing operation between the open state and the closed state of the first cover.

2. The sheet feeding device according to claim 1, wherein the restricting part includes:

a protrusion which protrudes from the second cover;

a restricting member capable of changing positions between a first position at which the restricting member comes into contact with the protrusion and restricts the opening angle of the second cover to the second opening angle, and a second position at which the restricting member restricts the opening angle of the second cover to the third opening angle while coming into contact with the protrusion; and a move part which moves the restricting member to the first position or the second position in accordance with the first cover in the open state or the closed state.

3. The sheet feeding device according to claim 2, wherein the second cover is openable/closable by being rotated with a rotating axis extending in a direction which intersects with a feeding direction of the sheet as a fulcrum, the protrusion is an arc shaped member centered around the rotating axis, and protruded at a position at a predetermined interval from the rotating axis in a radial direction of the rotation, the restricting member includes:

a ring part capable of turning around the rotating axis;

a first protruding part which protrudes from the ring part to an outer radial side, and is capable of coming into contact with the protrusion; and a second protruding part which protrudes from the ring part to the outer radial side at an interval from the first protruding part in a peripheral direction of the rotation, and the move part includes:

a bracket which is fixed to the housing and includes a first wall part and a second wall part placed opposite each other so as to sandwich the second protruding part of the restricting member in a direction which intersects with the rotating axis;

a biasing member disposed in a compressible manner between the first wall part and the second protruding part; and a contact piece disposed on the first cover, which comes into contact with the second protruding part on a side that is opposite to the biasing member to cause the restricting member to be disposed at the second position when the first cover is in the closed state, and which is separated from the second protruding part and, by the second protruding part coming into contact with the second wall part in association with the turning of the ring part, permits the restricting member to be disposed at the first position when the first cover is in the open state.

4. The sheet feeding device according to claim 3, wherein in a state where the second cover is in the open state and the restricting member disposed at the second position and the protrusion are in contact, when the first cover is changed from the closed state to the open state, the biasing member changes the opening angle of the second cover from the third opening angle to the second opening angle by moving the restricting member in contact with the protrusion from the second position to the first position.

5. The sheet feeding device according to claim 1, wherein the sheet is fed from a lower side toward an upper side on the first feeding path and the second feeding path, the sheet feeding device further comprising:

a first sheet loading part which is detachably mounted on the housing and feeds the sheet to the first feeding path; and a second sheet loading part which is detachably mounted on the housing and feeds the sheet to the second feeding path.

6. A sheet feeding device comprising:

a housing;

a first feeding path extending in a vertical direction within the housing and on which a sheet is fed;

a second feeding path extending in the vertical direction within the housing and having a lower end connected to an upper end of the first feeding path and on which a sheet is fed;

a first cover having a lower side with a first rotating axis and an upper side that is openable/closable relative to the housing by being turned around the first rotating axis, the first cover exposing the first feeding path outside of the housing when the first cover is in an opening state, and the first cover covering the first feeding path when the first cover is in a closed state; and a second cover having a lower side with a second rotating axis and an upper side that is openable/closable relative to the housing by being turned around the second rotating axis, the second cover having a cover part that exposes the second feeding path outside of the housing in an open state of the second cover, and the cover part covering the second feeding path in a closed state of the second cover, a leg extending down from the cover part outside the first feeding path in a sheet width direction that intersects a feeding direction of the sheet and reaching the first rotating axis, the second rotating axis being disposed in the leg and being coaxially with the first rotating axis and lower than an upper edge of the first cover, wherein when both the first cover and the second cover are in the open state, a second opening angle of the second cover relative to the housing is smaller than a first opening angle of the first cover relative to the housing, when the second cover is in a closed state, the first opening angle of the first cover is a first angle θA, and when the second cover is in the open state, the first opening angle of the first cover is a second angle OB that is greater than the first angle θA.

7. The sheet feeding device according to claim 1, further comprising an interlocking part for changing the first opening angle of the first cover from the first angle θA to the second angle θB in conjunction with a change from the closed state to the open state of the second cover.

8. The sheet feeding device according to claim 7, wherein the interlocking part includes:

a cylindrical part which protrudes toward the sheet width direction from a side face of the first cover part and serves as the first rotating axis;

a protruding part which protrudes from the cylindrical part in a direction of an outer radial side of the cylindrical part;

a hole opened in the leg of the second cover and through which the cylindrical part is inserted; and a guide part which is a notch in the leg, the guide part expanding a part of the hole in the outer radial side, and enables the protruding part to move in the peripheral direction.

9. The sheet feeding device according to claim 8, wherein the leg includes a first wall part which demarcates an upstream end of the guide part in a rotating direction of the second cover, and a second wall part which demarcates a downstream end of the guide part in the rotating direction, when the first cover and the second cover are in the closed state, the protruding part is disposed between the first wall part and the second wall part, and when the second cover is in the closed state, an opening angle of the first cover is restricted to the first angle θA by the first cover being opened and the protruding part coming into contact with the second wall part.

10. The sheet feeding device according to claim 8, wherein when the first cover is in the open state, the opening angle of the first cover is changed from the first angle θA to the second angle θB by the second cover being opened and the guide part being turned in a state where the second wall part supports the protruding part.

11. The sheet feeding device according to claim 8, wherein when the first cover is in the closed state, an opening angle of the second cover is restricted by the second cover being opened and the first wall part coming into contact with the protruding part.

12. The sheet feeding device according to claim 9, further comprising a restricting member which is bent and placed across the second cover and the housing when the second cover is in the closed state, and the bend is extended in response to opening of the second cover and restricts an opening angle of the second cover relative to the housing.

13. An image forming apparatus, comprising:

the sheet feeding device according to claim 1; and an image forming unit for forming an image on the sheet fed from the first feeding path or the second feeding path.

* * * * *